US010303114B2

(12) United States Patent
Katayama

(10) Patent No.: US 10,303,114 B2
(45) Date of Patent: May 28, 2019

(54) IMAGE FORMING UNIT

(71) Applicant: CANON KABUSHIKI KAISHA, Tokyo (JP)

(72) Inventor: Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/992,424

(22) Filed: Jan. 11, 2016

(65) Prior Publication Data

US 2016/0209803 A1 Jul. 21, 2016

(30) Foreign Application Priority Data

Jan. 15, 2015 (JP) ..... 2015-005619

(51) Int. Cl.
*G03G 21/18* (2006.01)
*G03G 21/16* (2006.01)

(52) U.S. Cl.
CPC ..... *G03G 21/1661* (2013.01); *G03G 21/185* (2013.01); *G03G 21/1832* (2013.01); *G03G 21/1842* (2013.01)

(58) Field of Classification Search
CPC ..... G03G 21/1661; G03G 21/1842; G03G 21/185; G02G 21/1832
USPC ..... 399/111, 114
See application file for complete search history.

(56) References Cited

U.S. PATENT DOCUMENTS 5,878,304 A * 3/1999 Watanabe ..... G03G 1/1832 399/114
8,055,154 B2 * 11/2011 Iikura ..... G03G 21/1832 399/111
2007/0206972 A1 * 9/2007 Tanaka ..... G03G 21/1832 399/114
2009/0080935 A1 3/2009 Iikura et al.
2012/0134711 A1 5/2012 Kusukawa

FOREIGN PATENT DOCUMENTS

JP 2002-132120 A 5/2002
JP 2007/240661 A 9/2007
JP 2009-075275 A 4/2009
JP 2009/075276 A 4/2009
(Continued)

OTHER PUBLICATIONS

Co-pending U.S. Appl. No. 15/001,571.
(Continued)

*Primary Examiner* — Hoang X Ngo
(74) *Attorney, Agent, or Firm* — Venable LLP

(57) ABSTRACT

An image forming unit mountable to an image forming apparatus includes a main assembly including an image bearing drum and insertable into the apparatus; a cover portion engaging with the main assembly of the unit to cover the drum; an inserting portion provided on the cover portion for insertion into the apparatus; a movable locking portion for locking the cover portion with the apparatus; and a moving mechanism for moving the locking portion to a locking position after the cover portion is mounted to the apparatus, and the main assembly of the unit is inserted into the apparatus by a predetermined amount from an insertion starting position, and for moving the locking portion from the locking position an unlocking position before completion of mounting of the main assembly of the unit to the apparatus.

21 Claims, 29 Drawing Sheets

(56) References Cited

FOREIGN PATENT DOCUMENTS

| | | | |
|---|---|---|---|
| JP | 2010-078703 | A | 4/2010 |
| JP | 2012-118258 | A | 6/2012 |

OTHER PUBLICATIONS

Official Communication in European Patent Application No. 15202777.7, dated Jun. 10, 2016.

Office Action in Chinese Patent Application No. 201610020554.7 (with English translation).

* cited by examiner (a)

(b)

(a)

(b)

(a)

(b)

IMAGE FORMING UNIT

FIELD OF THE INVENTION AND RELATED ART

The present invention relates to a unit such as a drum cartridge detachably mountable to an image forming apparatus such as a copying machine, a printer, a facsimile machine or a multifunction machine having a plurality of functions thereof, and an image forming apparatus to which the unit is detachably mountable.

A structure in which a unit such as a drum cartridge, a process cartridge or the like is detachably mountable to the main assembly of the apparatus is known. An example of such a unit is provided with a covering member for protecting a member in the unit such as a photosensitive drum. Regarding the structure including such a covering member, Japanese Laid-open Patent Application 2002-132120 discloses that when the unit is inserted into the main assembly A, the covering member is engaged with a part of the main assembly, by which the covering member is disengaged from the unit.

In addition, Japanese Laid-open Patent Application 2007-240661 discloses that when the unit is set in the insertion position of the main assembly, the covering member is locked with the main assembly, and after the unit is inserted into the predetermined position in the main assembly, the locking is released. In addition, Japanese Laid-open Patent Application 2010-78703 discloses that when the unit is set in the insertion position of the main assembly, the covering member is locked with the main assembly, and the locking can be released at any time. In the cases of the Japanese Laid-open Patent Application 2007-240661 and Japanese Laid-open Patent Application 2010-78703, the unit is guided by a covering member locked to the main assembly. With this structure disclosed in Japanese Laid-open Patent Application and the cover member are locked with each other, and the locking between the unit and the cover member is released by the unit inserting operation in the state that the unit is mounted to the main assembly.

With this structure disclosed in Japanese Laid-open Patent Application 2002-132120, when the unit is set in the insertion position of the main assembly, the covering member is not locked on the main assembly, and therefore, the unit provided with the covering member may be disengaged from the main assembly unintentionally.

On the other hand, with the structure disclosed in Japanese Laid-open Patent Application 2007-240661, when the unit is set in the insertion position of the main assembly, the covering member is locked on the main assembly, but the locking is not released until the unit is mounted to the predetermined position of the main assembly of the apparatus. In this case, when a wrong unit is mounted, the covering member is unable to be dismounted from the main assembly of the apparatus as long as the unit is inserted into the predetermined position. In such a case, the unit having been inserted to the predetermined position is removed in the state that the cover member is not closed, with the result that an image formation member such as a photosensitive drum in the unit it exposed.

A structure in which the locking between the unit and the cover member is released in the inserting operation of the unit as disclosed in Japanese Laid-open Patent Application 2010-78703, for example, would be considered. In this case, however, when the releasing is disabled due to some failure in the locking mechanism for between the unit and the covering member, the unit cannot be inserted into the predetermined position, with the result that the releasing of the locking between the covering member and the main assembly is not possible.

On the other hand, with the structure disclosed in Japanese Laid-open Patent Application 2010-78703, the locking between the covering member and the main assembly can be released at any time. However, it is desirable that the locking between the covering member and the main assembly is disabled until the unit is inserted into the main assembly to a certain extent. This is because if the covering member is disengaged from the main assembly during the insertion of the unit, the unit guided by the cover member may be disengaged from the main assembly. If this occurs, that is, if the covering member is disengaged from the main assembly partway of the unit insertion, the image formation member such as the photosensitive drum provided in the unit may be exposed.

SUMMARY OF THE INVENTION

It is an object of the present invention to provide an image forming unit in which the covering member is locked, and the unit can be dismounted without the necessity of moving the unit in the unit mounting operation.

According to an aspect of the present invention, there is provided an image forming unit detachably mountable to an image forming apparatus, said image forming unit comprises a main assembly including an image bearing member and insertable into the image forming apparatus; a cover portion engaging with the main assembly of said unit to cover said image bearing member; an inserting portion provided on said cover portion for insertion into said image forming apparatus; a movable locking portion configured to lock said cover portion with the image forming apparatus; a moving mechanism configured to move said locking portion to a locking position after said cover portion is mounted to the image forming apparatus, and the main assembly of said image forming unit is inserted into the image forming apparatus by a predetermined amount from an insertion starting position, and configured to move said locking portion from the locking position an unlocking position before completion of mounting of the main assembly of said image forming unit to the image forming apparatus.

Further features of the present invention will become apparent from the following description of exemplary embodiments with reference to the attached drawings.

Figure 2:
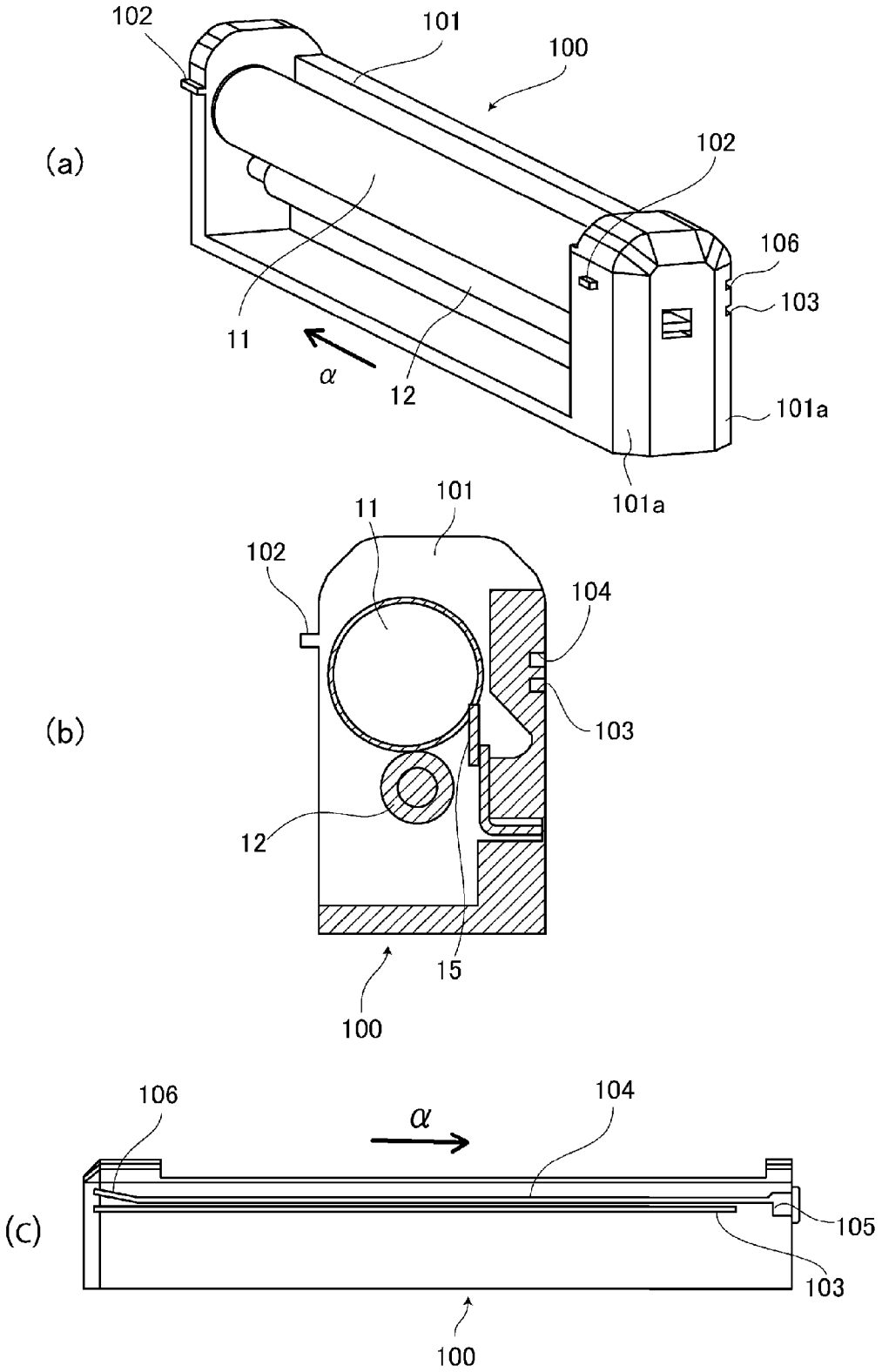

Part (a) of FIG. 2 is a perspective view of a drum cartridge according to the first embodiment, (b) is a sectional view, (c) is a side view as seen from a right side in part (b).

Figure 3:
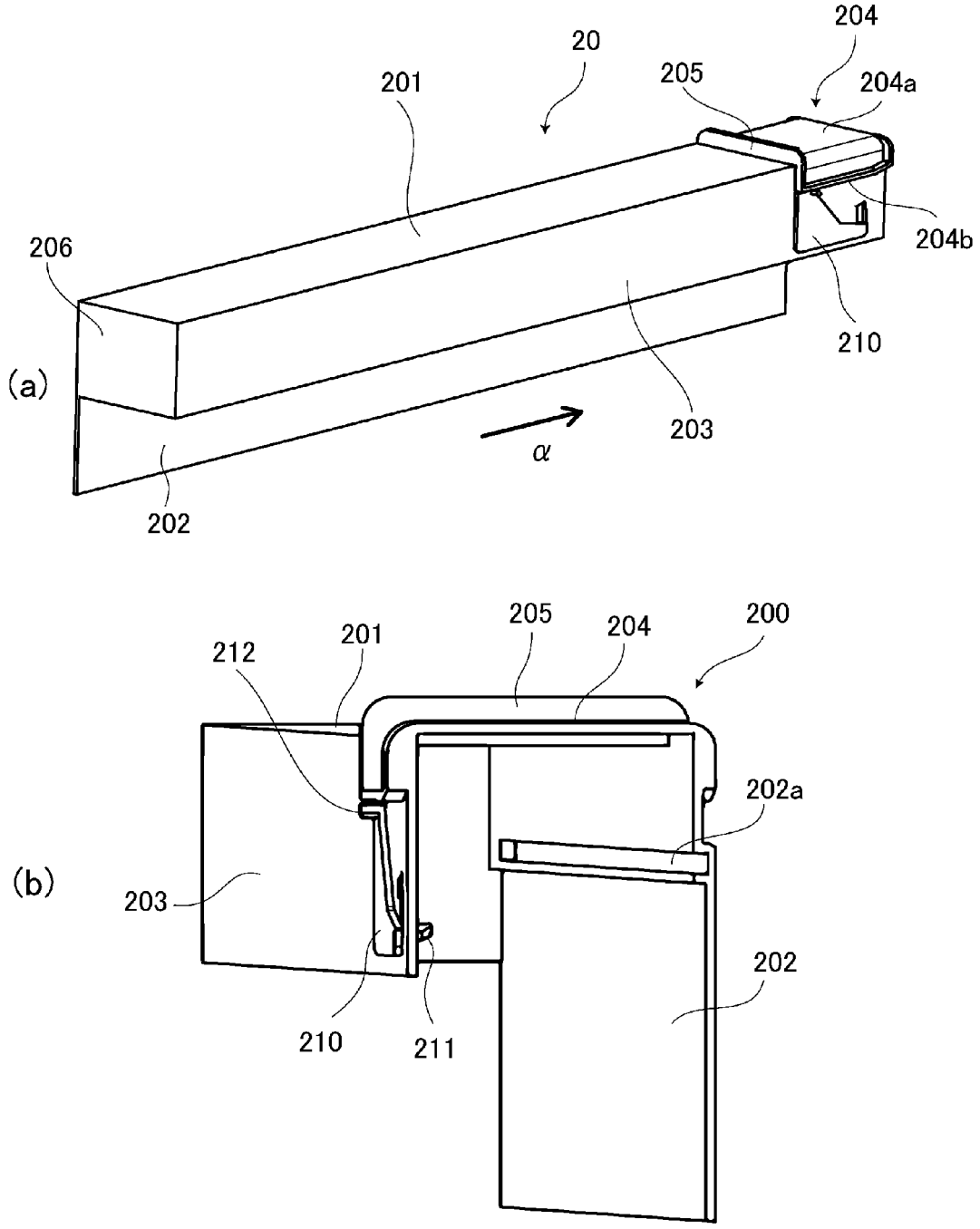

Part (a) of FIG. 3 is a perspective view of the covering member in the first embodiment, (b) is a perspective view as seen in the inserting direction from a leading end.

Figure 4:
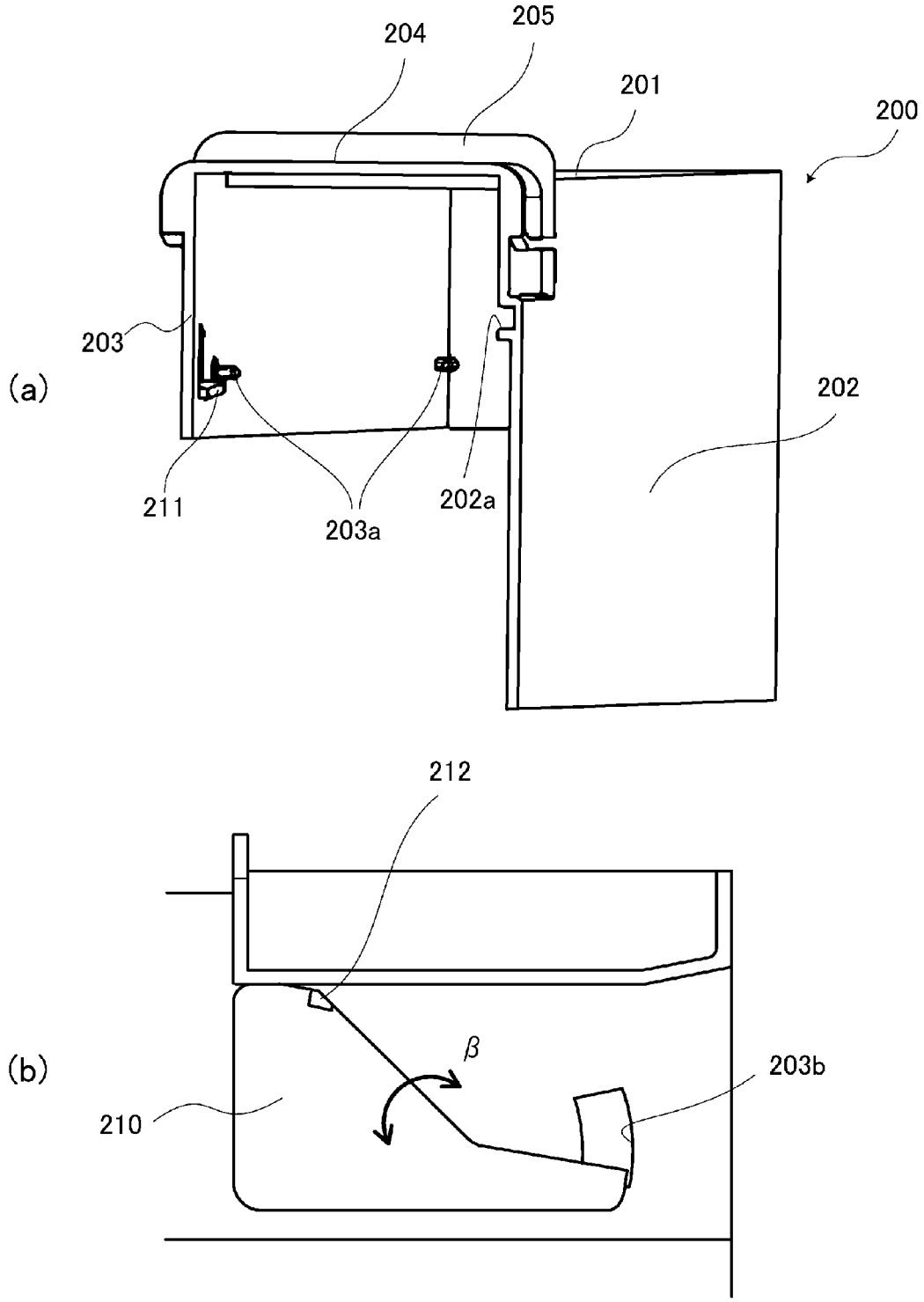

Part (a) of FIG. 4 is a perspective view of the covering member in the first embodiment as seen from the leading end in the inserting direction at an angle different from the angle in part (b) of FIG. 3, (b) is an enlarged side view of a part.

Figure 5:
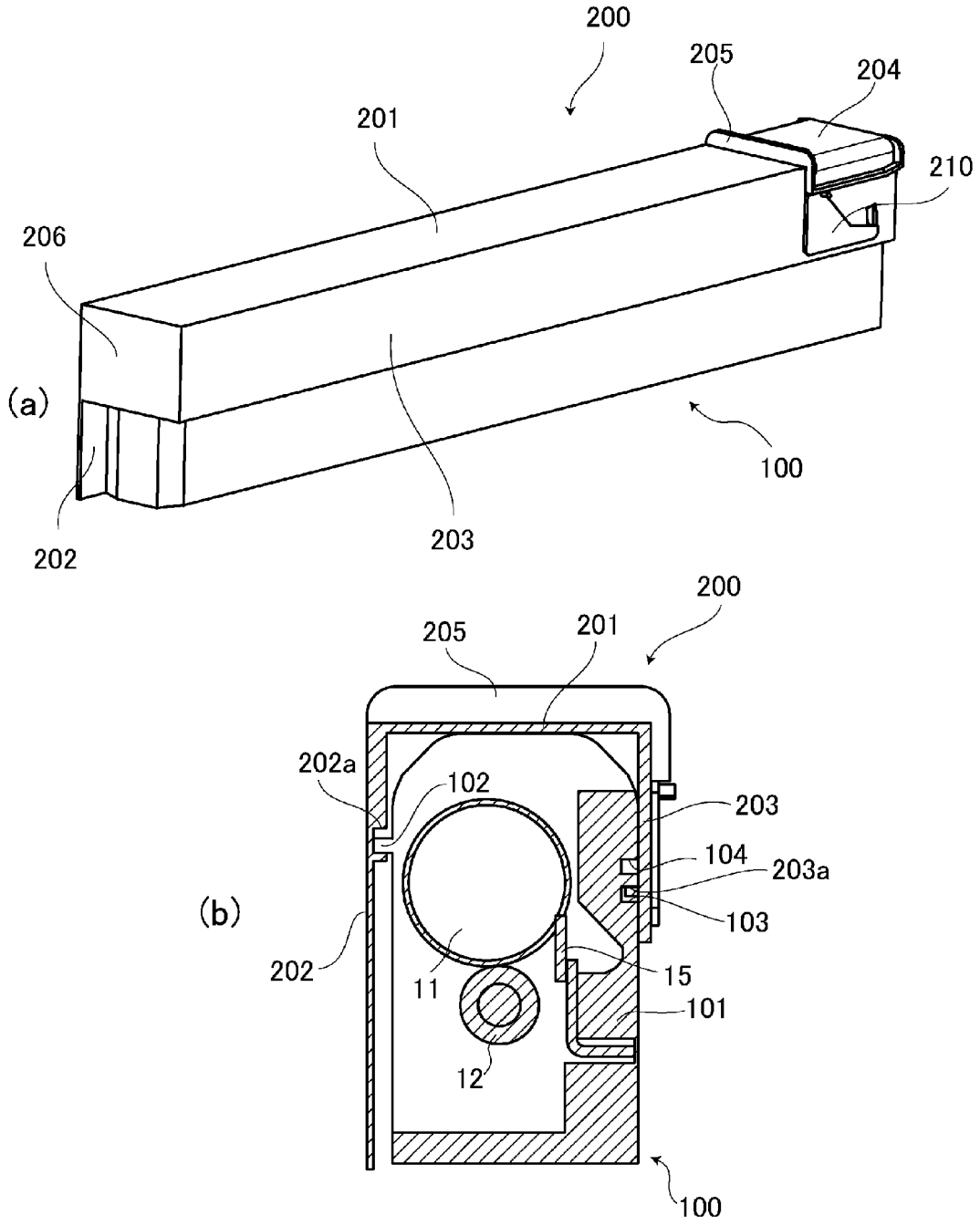

Part (a) of FIG. 5 is a perspective view illustrating a state in which the drum cartridge according to the first embodiment is protected by the cover ember, and part (b) is a sectional view.

Figure 6:
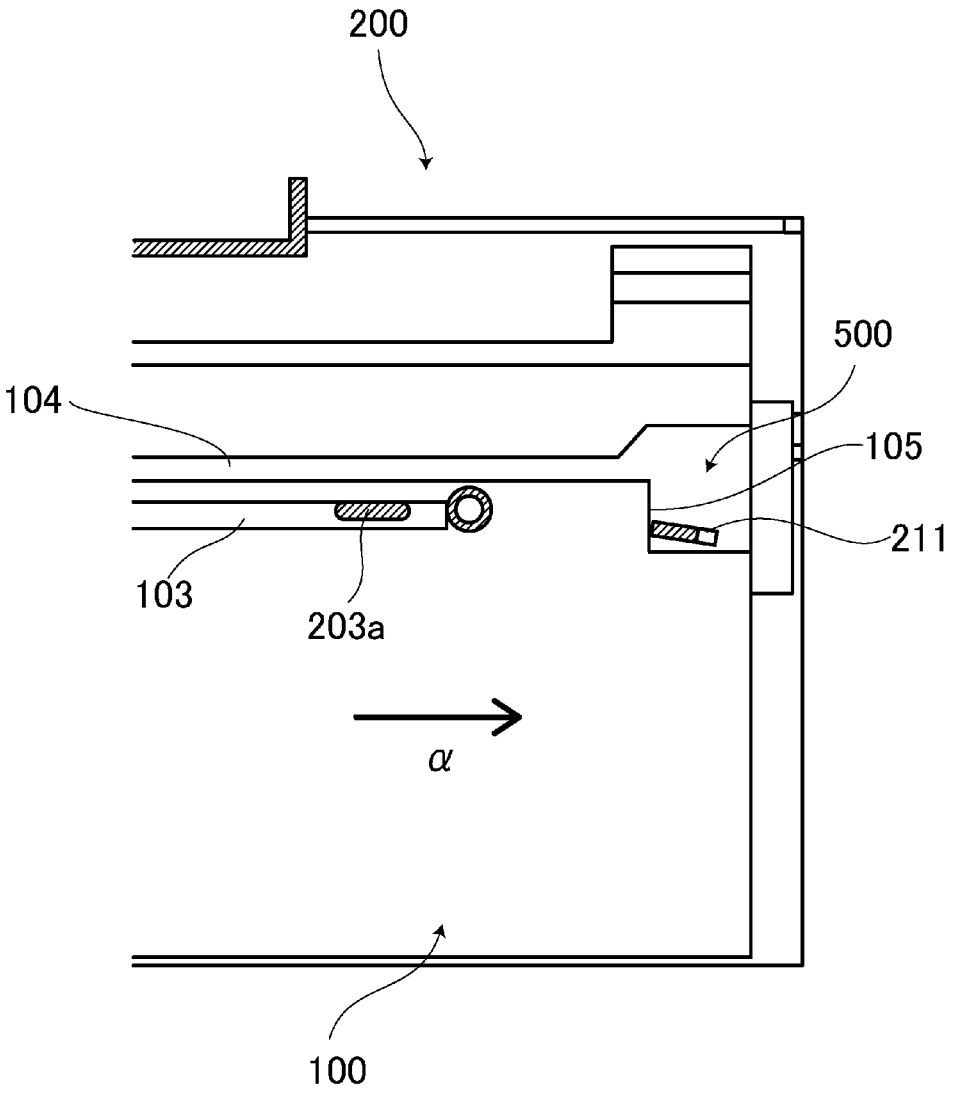

FIG. 6 is a sectional view illustrating the locking state of the drum cartridge of the covering member according to the first embodiment.

Figure 7:
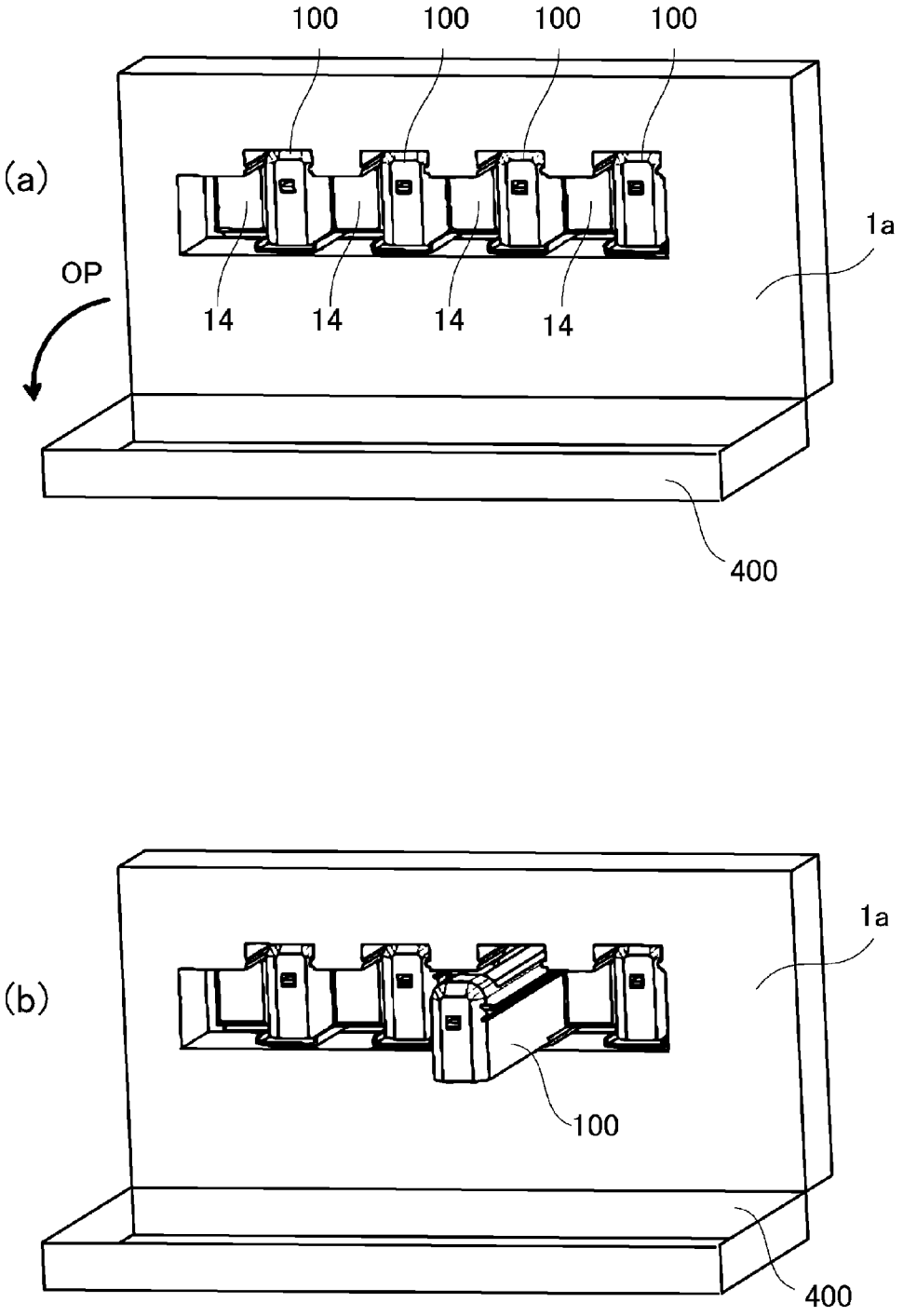

Part (a) of FIG. 7 is a perspective view showing a part of the main assembly according to the first embodiment in which the front cover is opened, and (b) is a perspective view showing a state in which the drum cartridge is dismounted from the main assembly.

Figure 8:
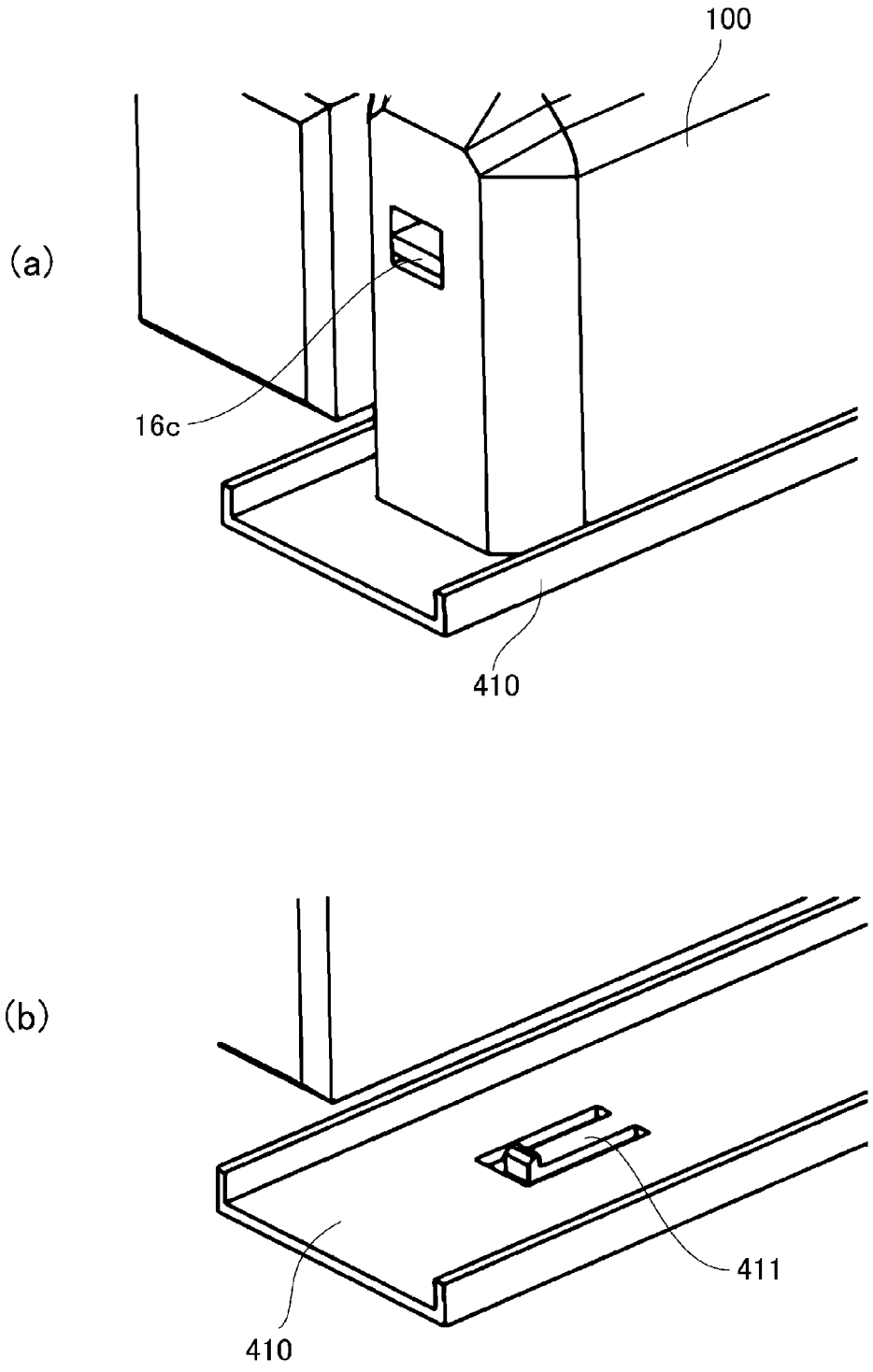

Part (a) of FIG. 8 is a perspective view of a part of the main assembly of the apparatus according to the first embodiment in a state in which the drum cartridge is placed on a rail, and (b) shows the state in which the drum cartridge is removed from the rail.

Figure 9:
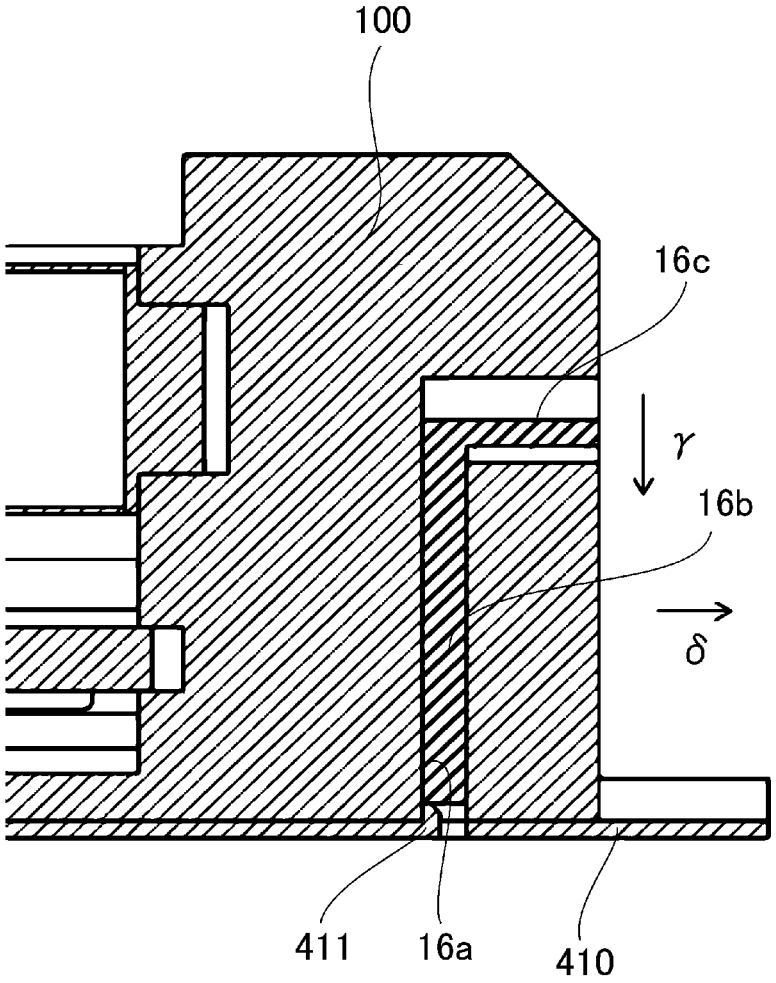

FIG. 9 is a sectional view illustrating a locking mechanism between the drum cartridge and the rail in the first embodiment.

Figure 10:
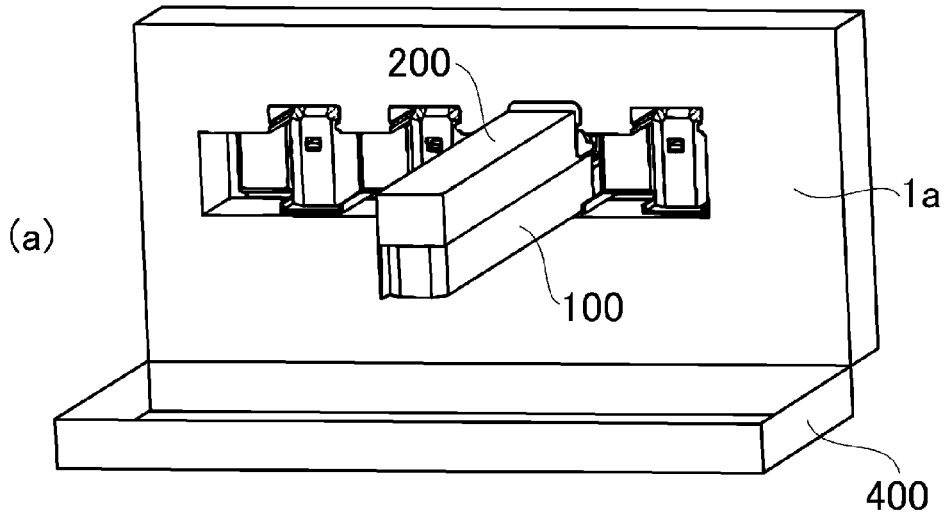
Figure 10:
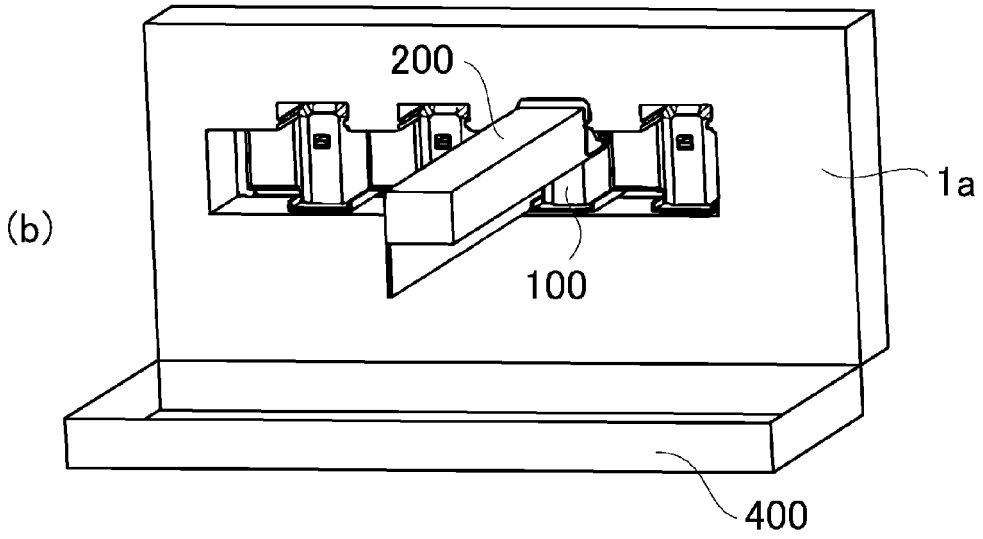

Part (a) of FIG. 10 is a perspective view of a part of the main assembly according to the first embodiment showing a state in which the drum cartridge is set in the insertion position through the covering member, (b) is a perspective view showing a state in which the drum cartridge is inserted in the main assembly.

Figure 11:
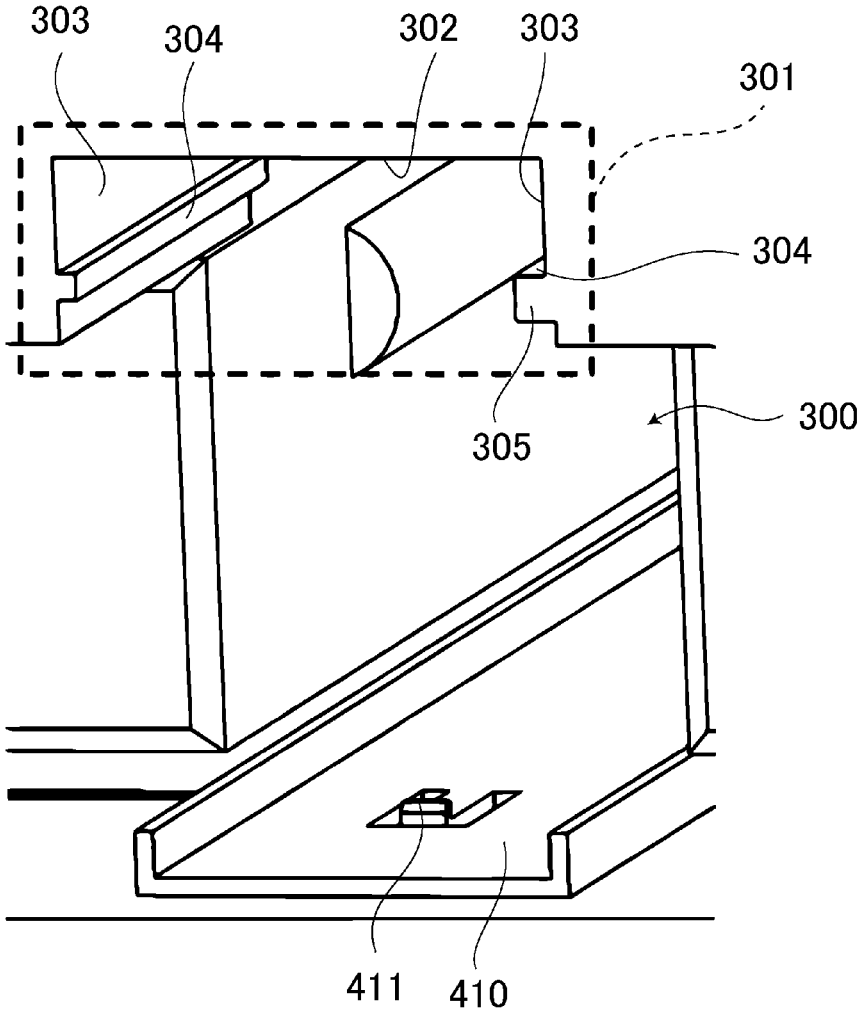

FIG. 11 is a perspective view of a part of the main assembly according to the first embodiment, showing a drum cartridge receiving portion.

Figure 12:
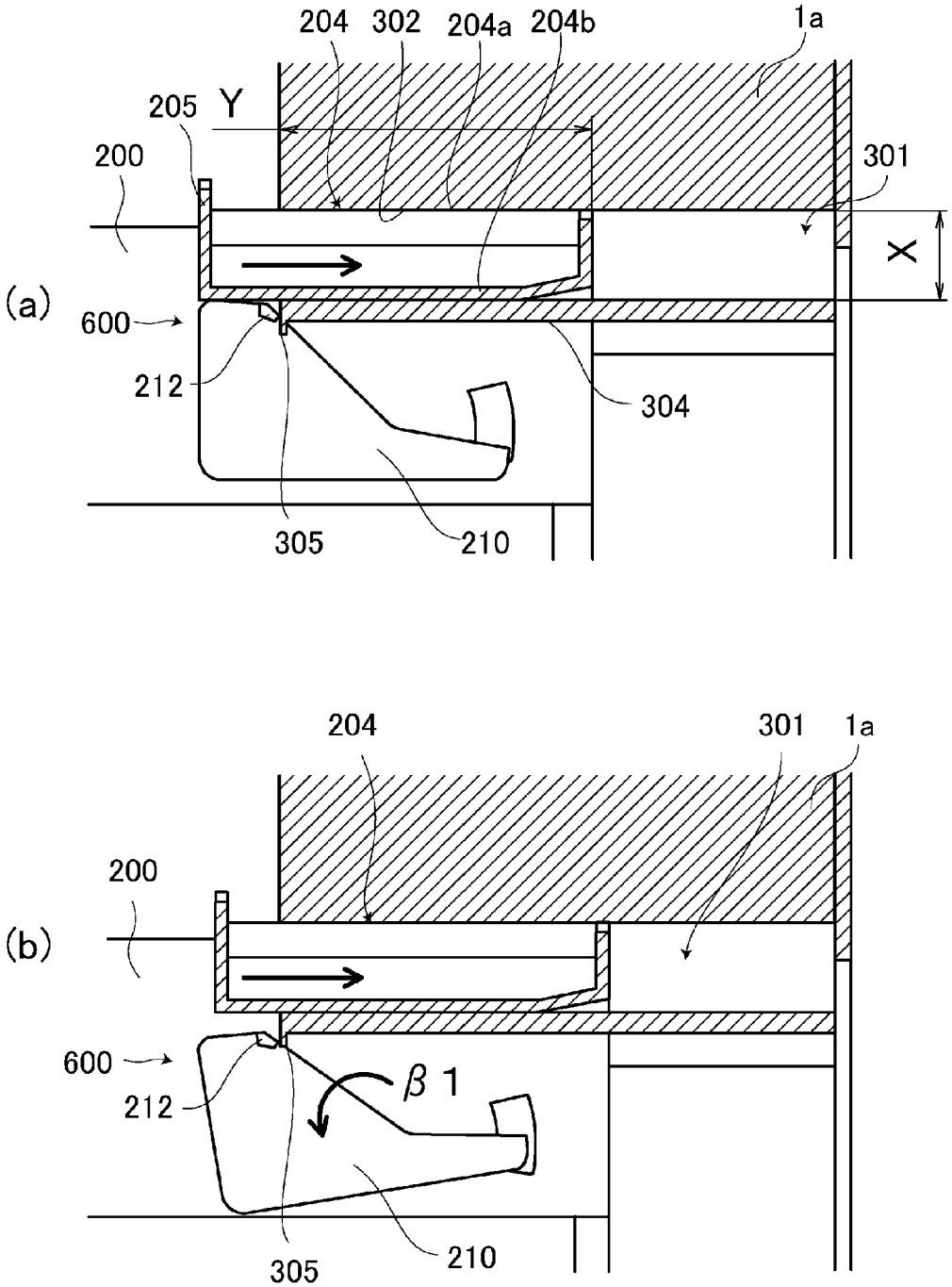

Part (a) of FIG. 12 is a sectional view illustrating the relationship between an engaging portion of the movable member and a portion-to-be-engaged of the main assembly in a first step of mounting of the drum cartridge to the main assembly, and (b) these sectional view illustrating it in the second step, in the first embodiment.

Figure 13:
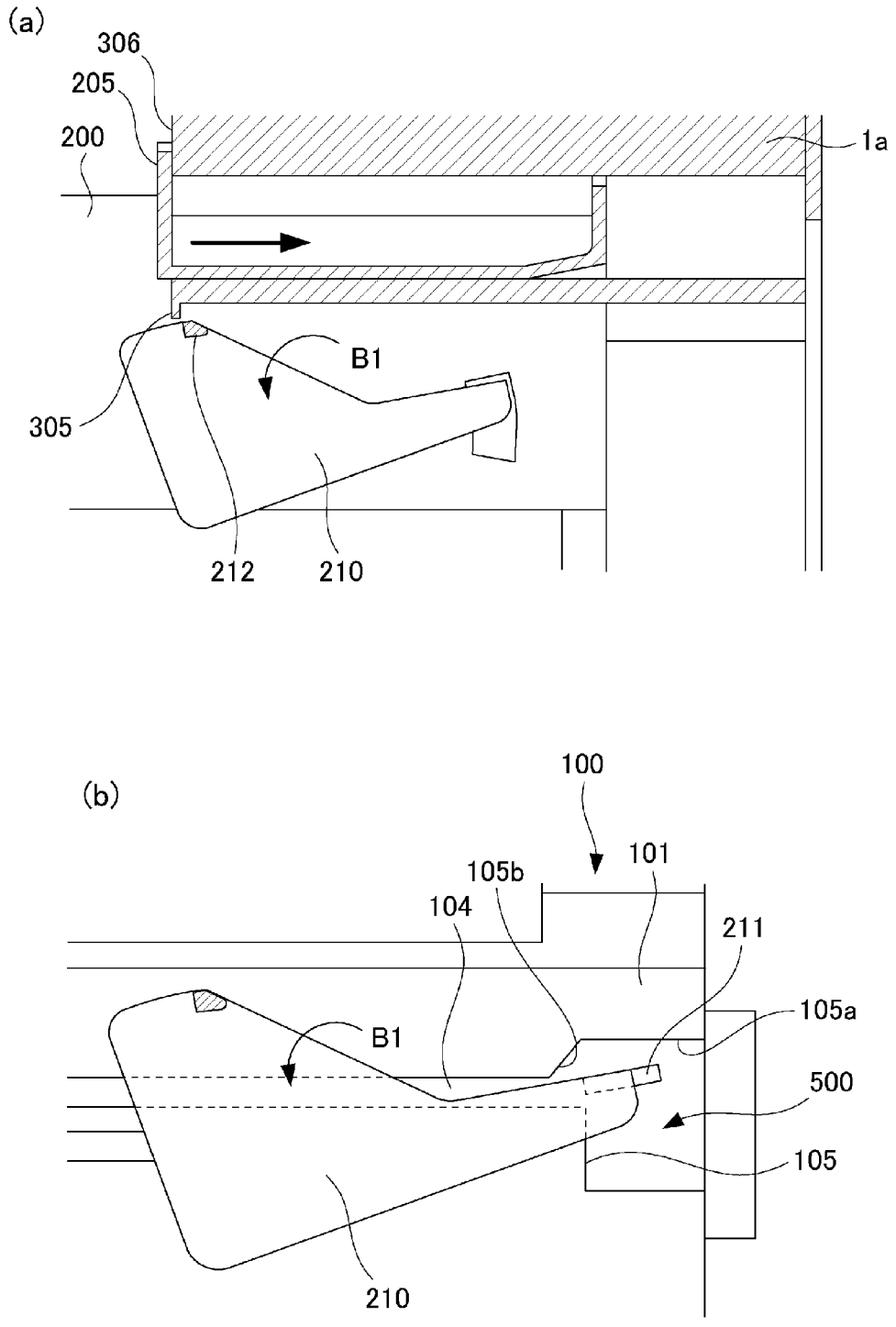

Part (a) of FIG. 13 these sectional view illustrating a relation between the engaging portion of the movable member and the portion-to-be-engaged of the main assembly in a third step of mounting the drum cartridge to the main assembly in the first embodiment, and (b) illustrates a relation between a projected portion of the movable member and a locking engaging portion of the main assembly.

Figure 14:
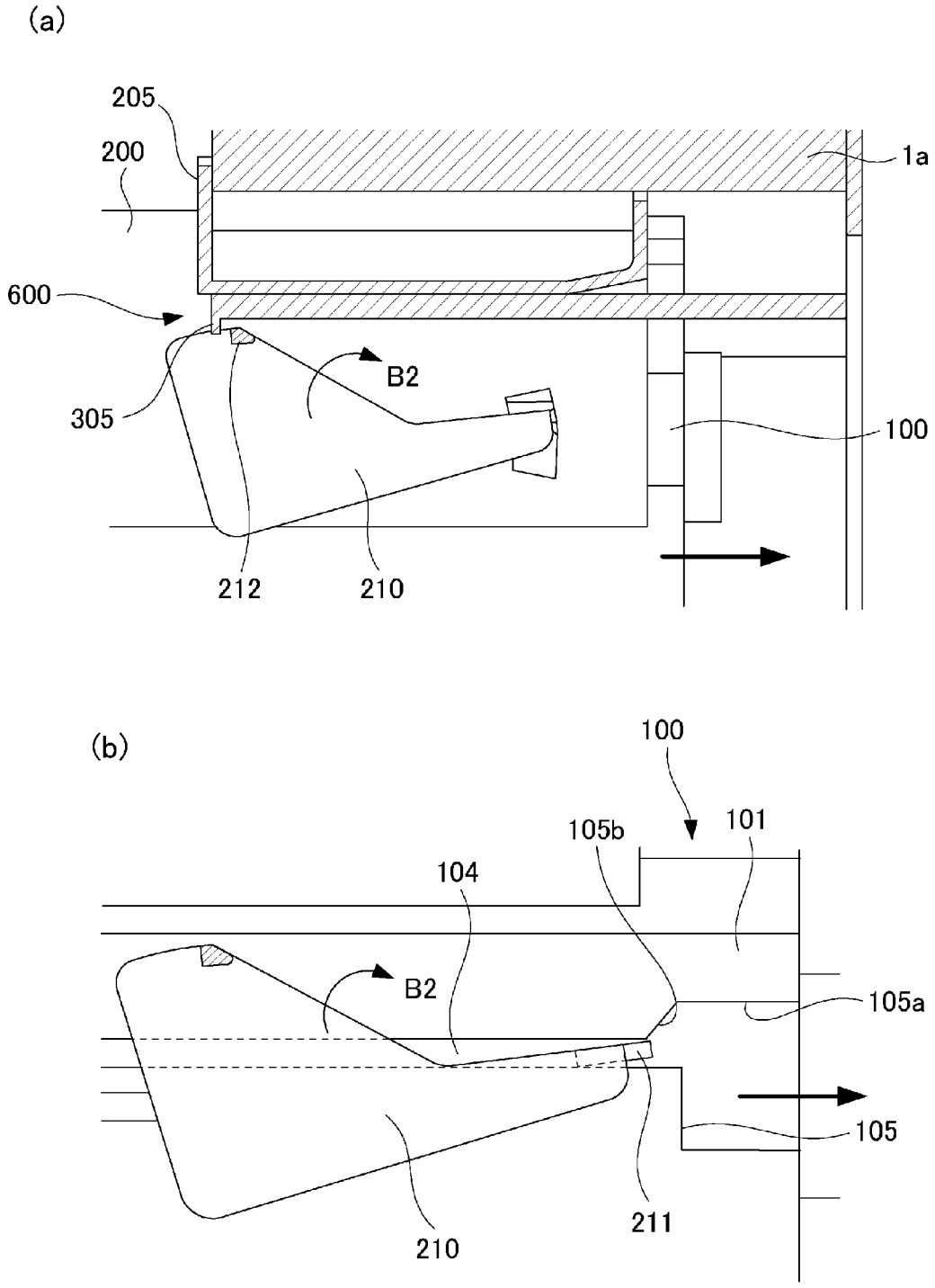

Part of (a) FIG. 14 is a sectional view showing a relation between the engaging portion of the movable member and the portion-to-be-engaged of the main assembly in a fourth step of mounting the drum cartridge to the main assembly, and (b) shows the relation between the projected portion of the movable member and a locking guide portion of the main assembly in the fourth step, according to the first embodiment.

Figure 15:
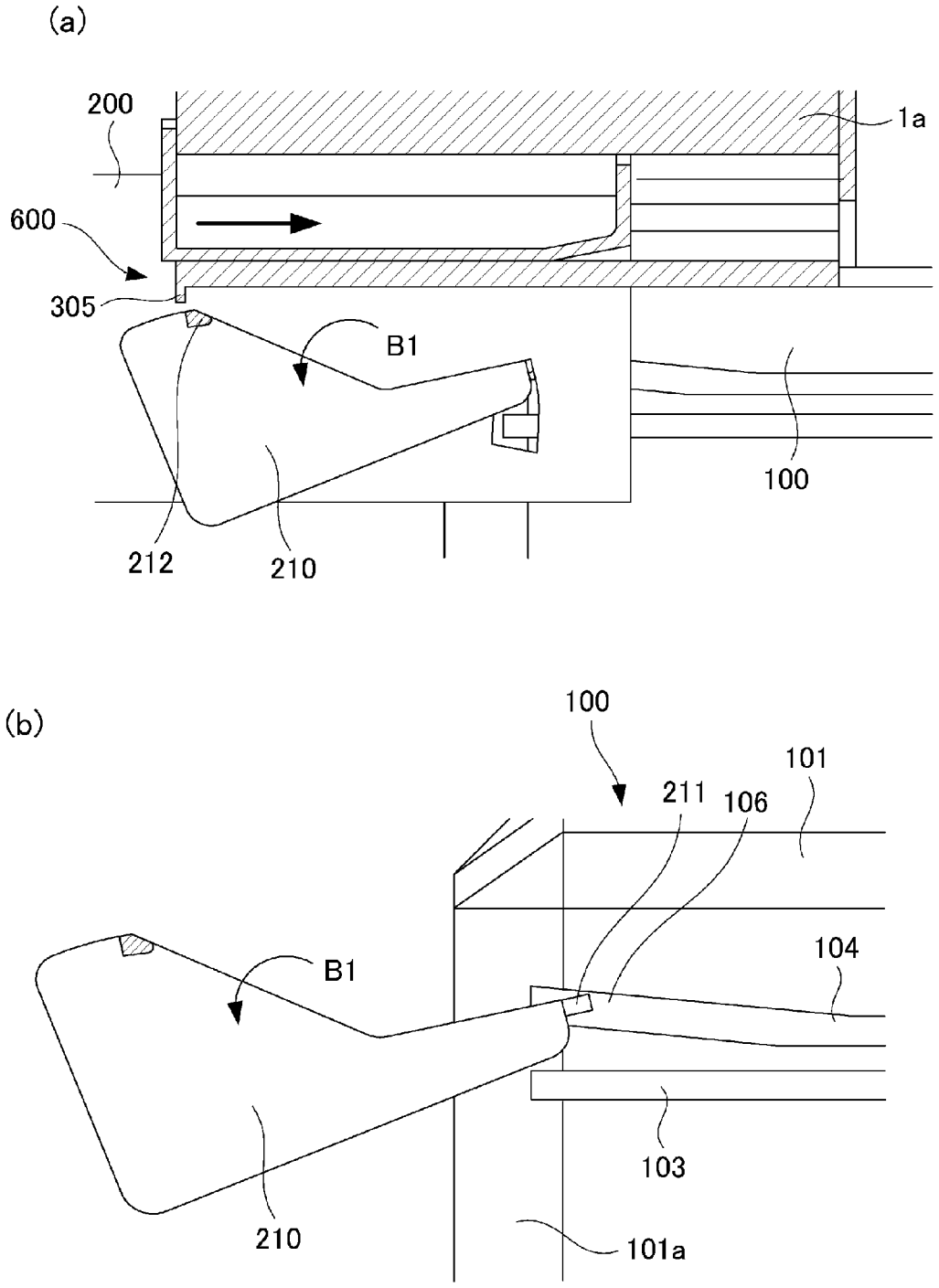

Part of (a) FIG. 15 is a sectional view showing a relation between the engaging portion of the movable member and the portion-to-be-engaged of the main assembly in a fourth step of mounting the drum cartridge to the main assembly, and (b) shows the relation between the projected portion of the movable member and a locking guide portion of the main assembly in the fourth step, according to the first embodiment.

Figure 16:
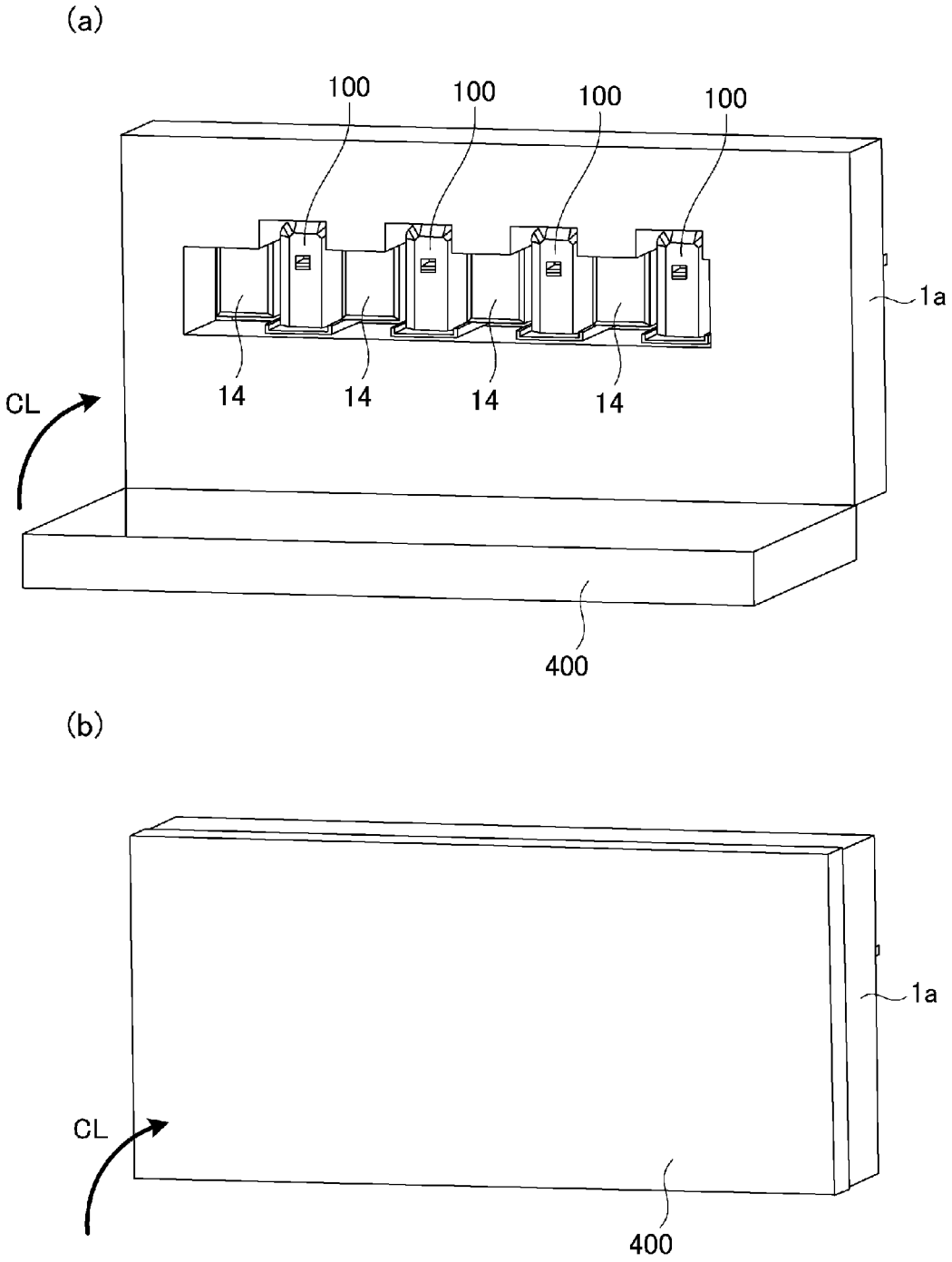

Part (a) of FIG. 16 is a perspective view of a part of the main assembly showing a state in which the drum cartridge is mounted to the main assembly, and (b) is a perspective view showing the state in which the front cover is closed, according to the first embodiment.

Figure 17:
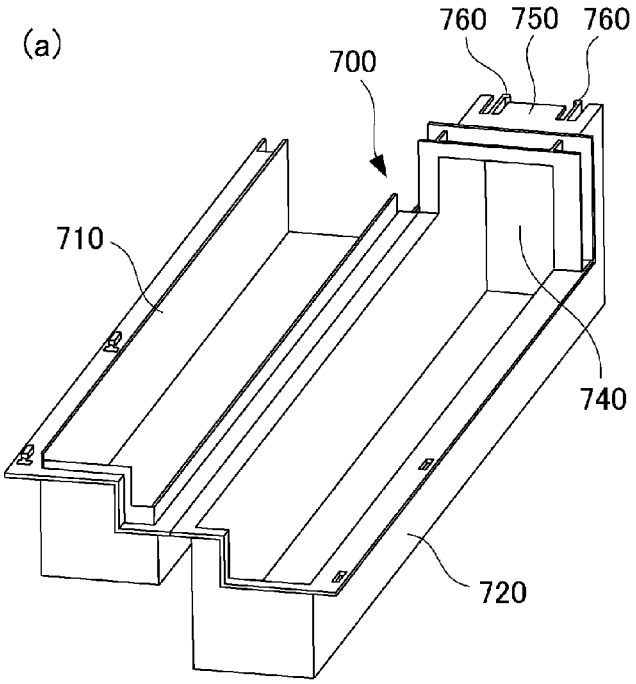
Figure 17:
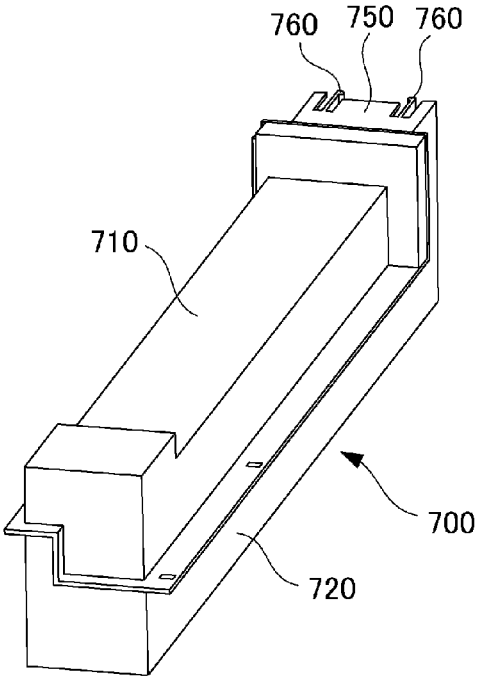

Part (a) of FIG. 17 is a perspective view of the covering member in the state that a closing member portion is opened, and (b) shows the covering member in the state in which the closing member portion is closed, in a second embodiment of the present invention.

Figure 18:
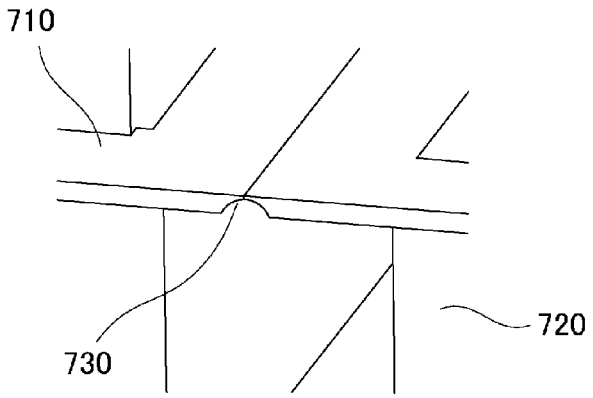
Figure 18:
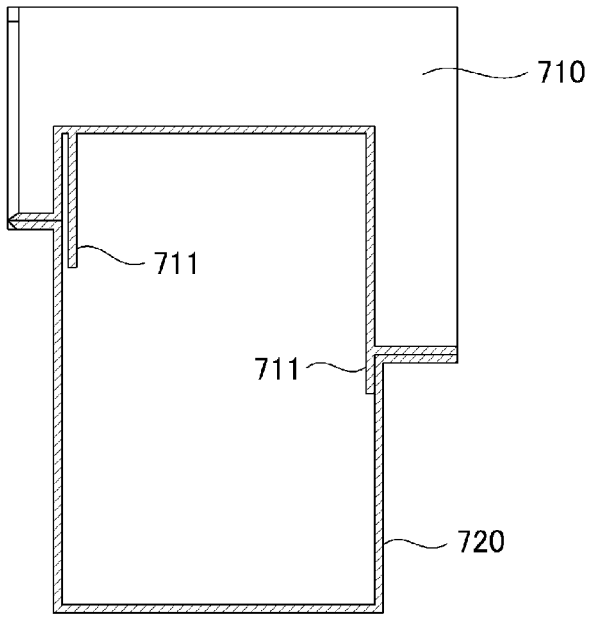

Part (a) of FIG. 18 is an enlarged perspective view over the covering member according to the second embodiment, and (b) is a sectional view thereof in the state that the closing member portion is closed.

Figure 19:
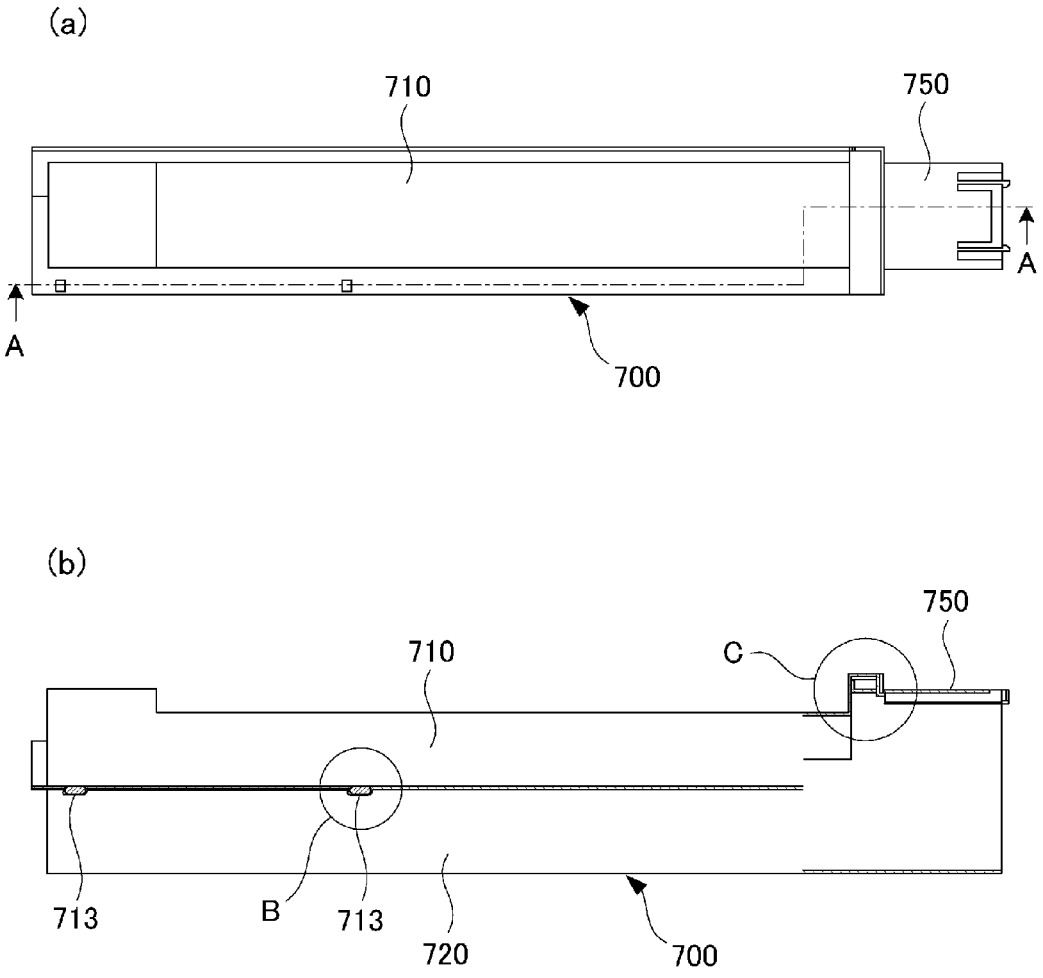

Part (a) of FIG. 19 is a top plan view of the covering member in the second embodiment, and (b) is a sectional view taken along a line A-A of part (a) of FIG. 19.

Figure 20:
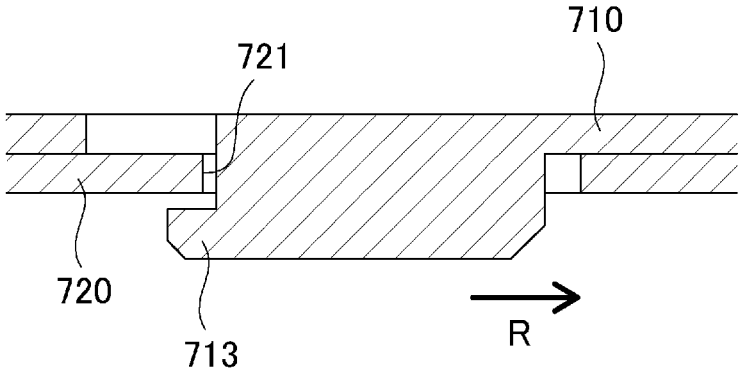
Figure 20:
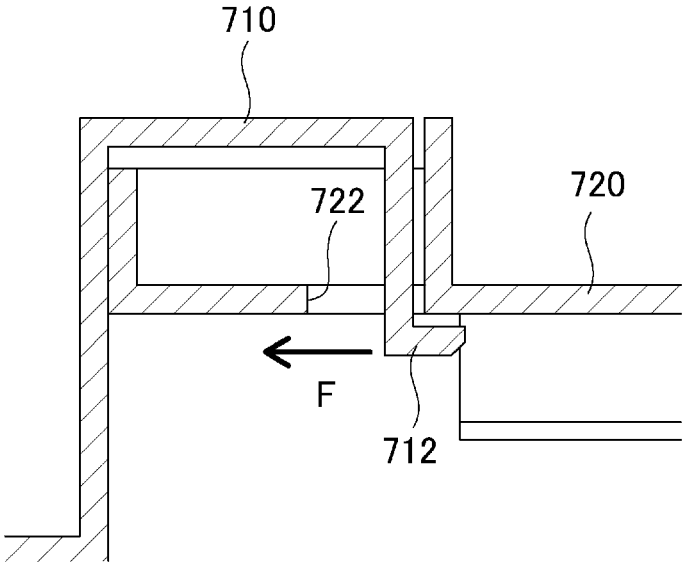

Part (a) of FIG. 20 is an enlarged view of a portion B of part (b) of FIG. 19, and part (b) is an enlarged view of a portion C of part (b) of FIG. 19.

Figure 21:
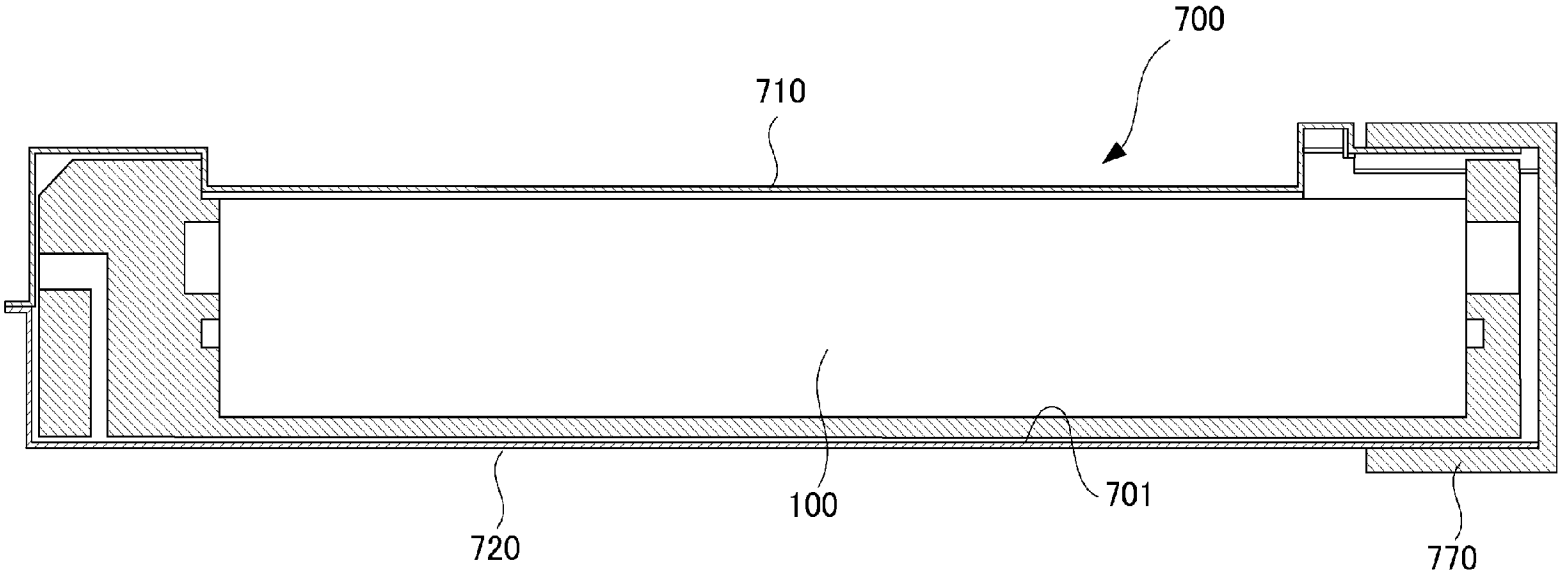

FIG. 21 is a sectional view showing a state in which the drum cartridge is protected by the covering member.

Figure 22:
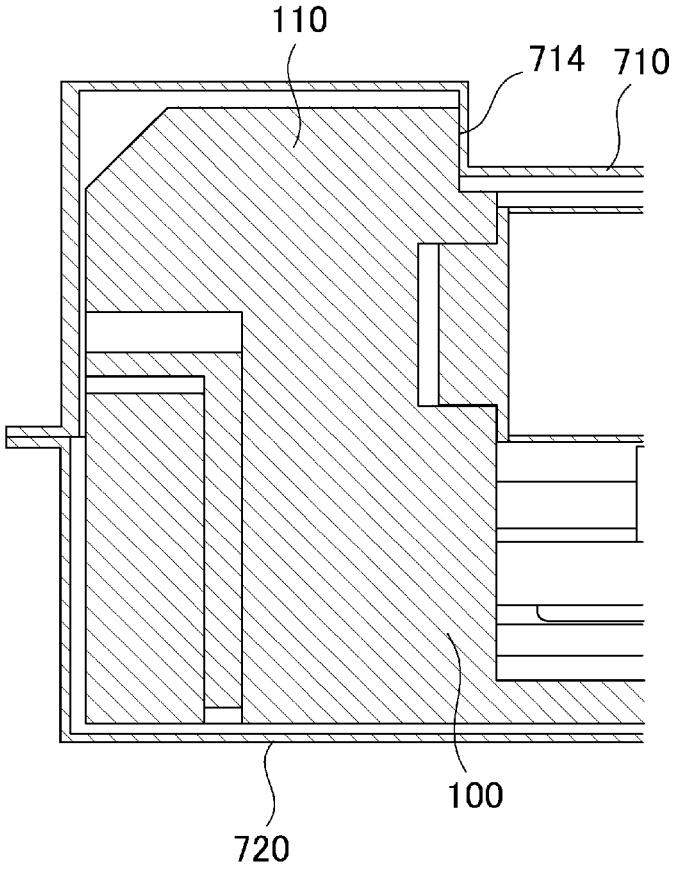

FIG. 22 is an enlarged view of the left end portion of FIG. 21.

Figure 23:
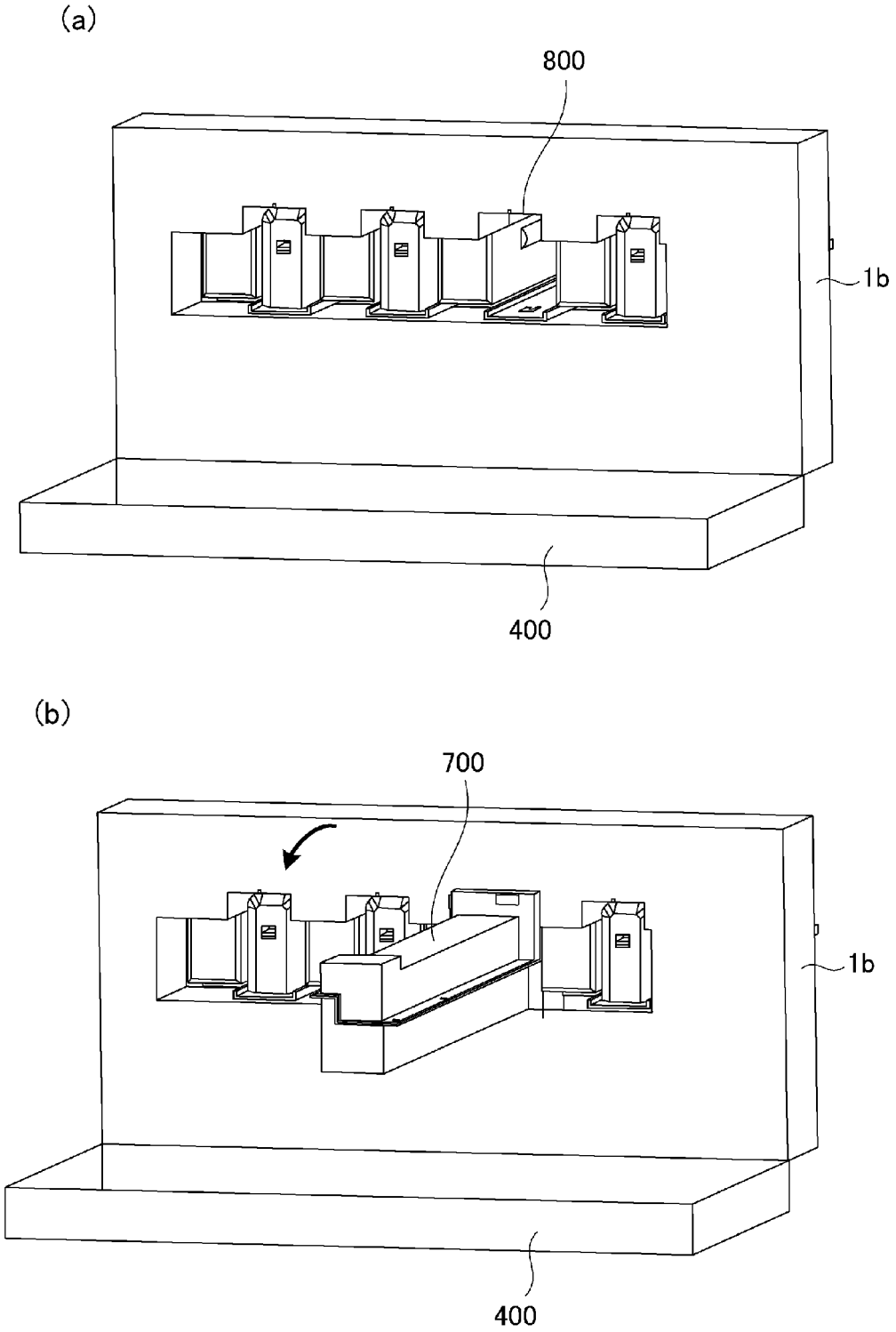

Part (a) of FIG. 23 is a perspective view of a part of the main assembly before the drum cartridge is set in the main assembly in the second embodiment, and (b) is a perspective view thereof after the drum cartridge is set in the insertion position through the covering member.

Figure 24:
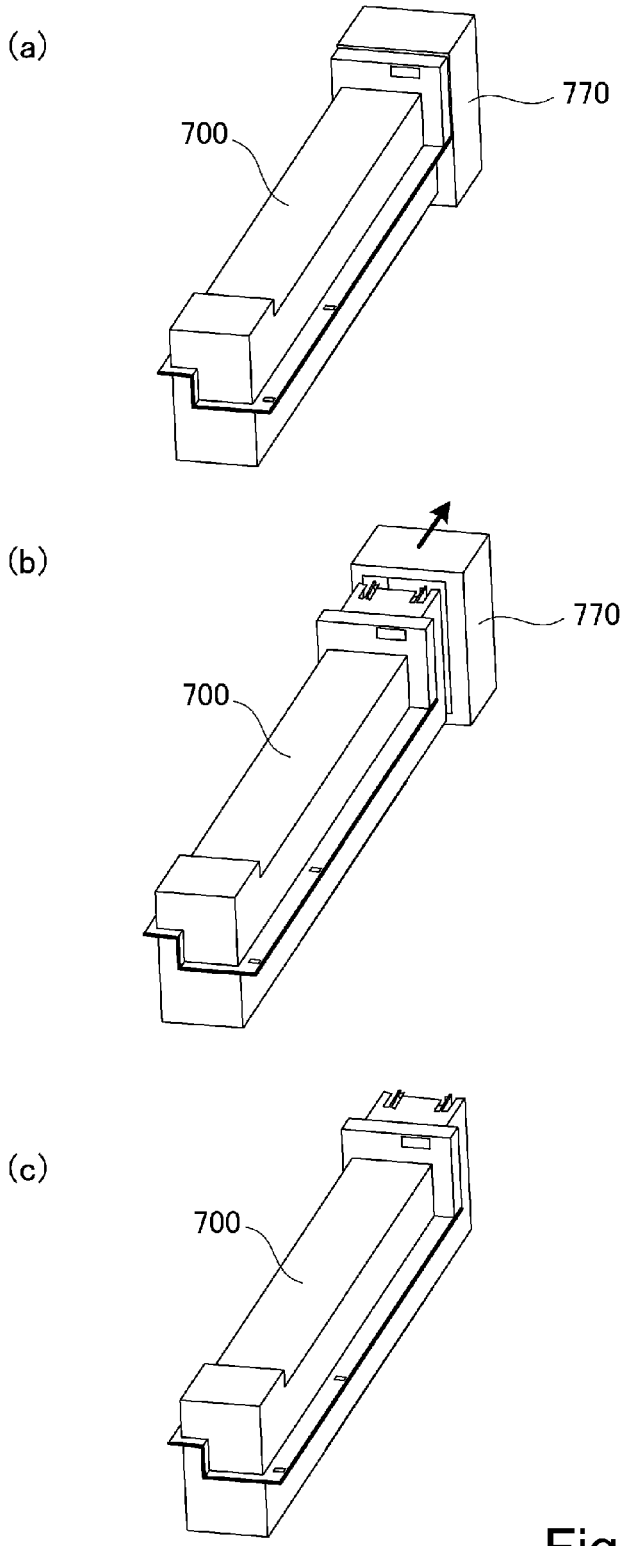

Part (a) of FIG. 24 is a perspective view showing a state before an end portion covering member is removed from the cover member in the second embodiment, (b) is a perspective view showing a state during the removal of the end portion covering member, and (c) is a perspective view showing a state after the end portion covering member is removed.

Figure 25:
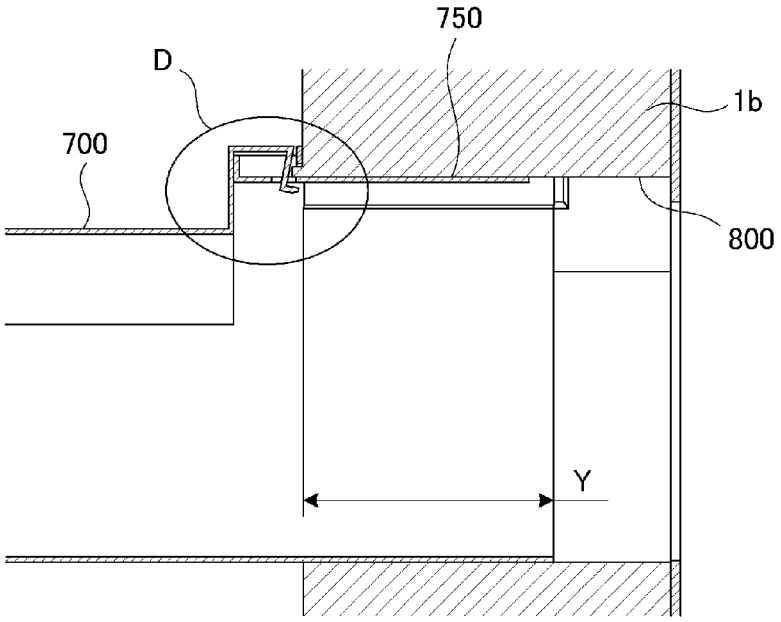

FIG. 25 is a sectional view when the drum cartridge provided with the cover member is set in the main assembly in the second embodiment.

Figure 26:
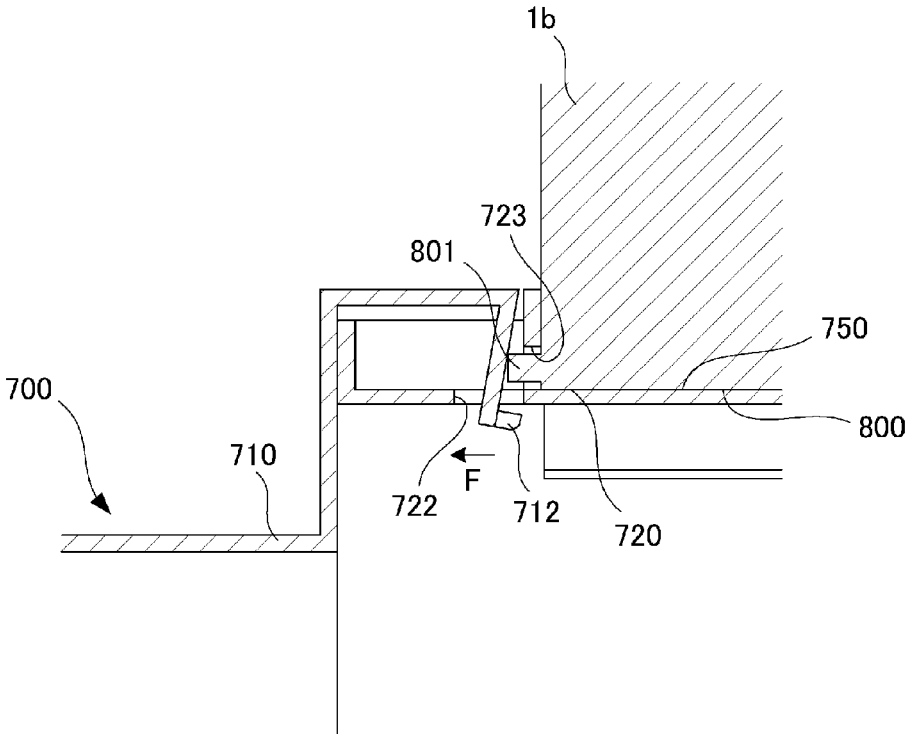

FIG. 26 is an enlarged view of a portion D of FIG. 25.

Figure 27:
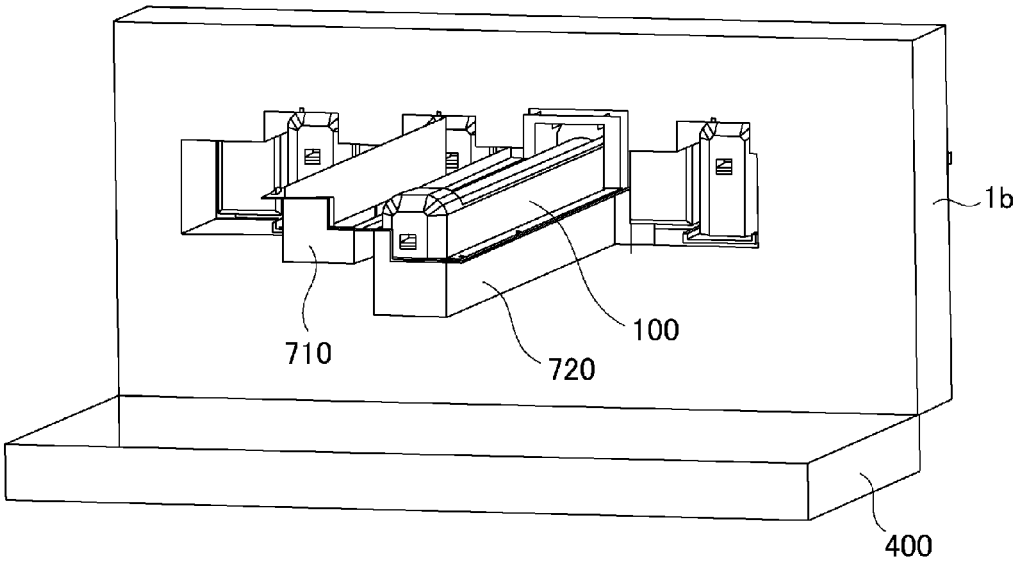
Figure 27:
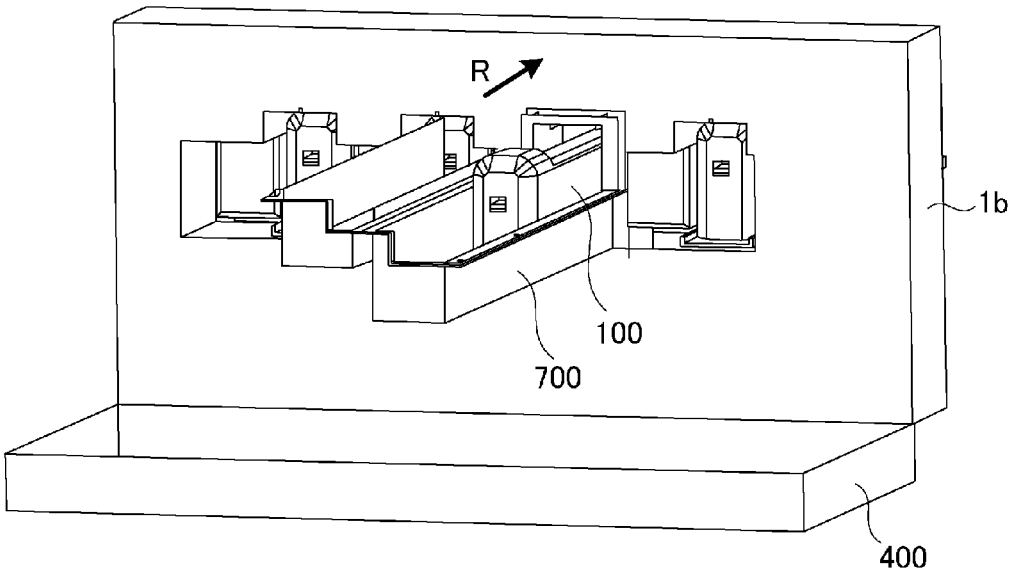

Part (a) of FIG. 27 is a perspective view of a part of the main assembly in the state that the closing member portion of the covering member set in the insertion position is opened in the second embodiment, (b) is a perspective view thereof in the state during the insertion of the drum cartridge into the main assembly.

Figure 28:
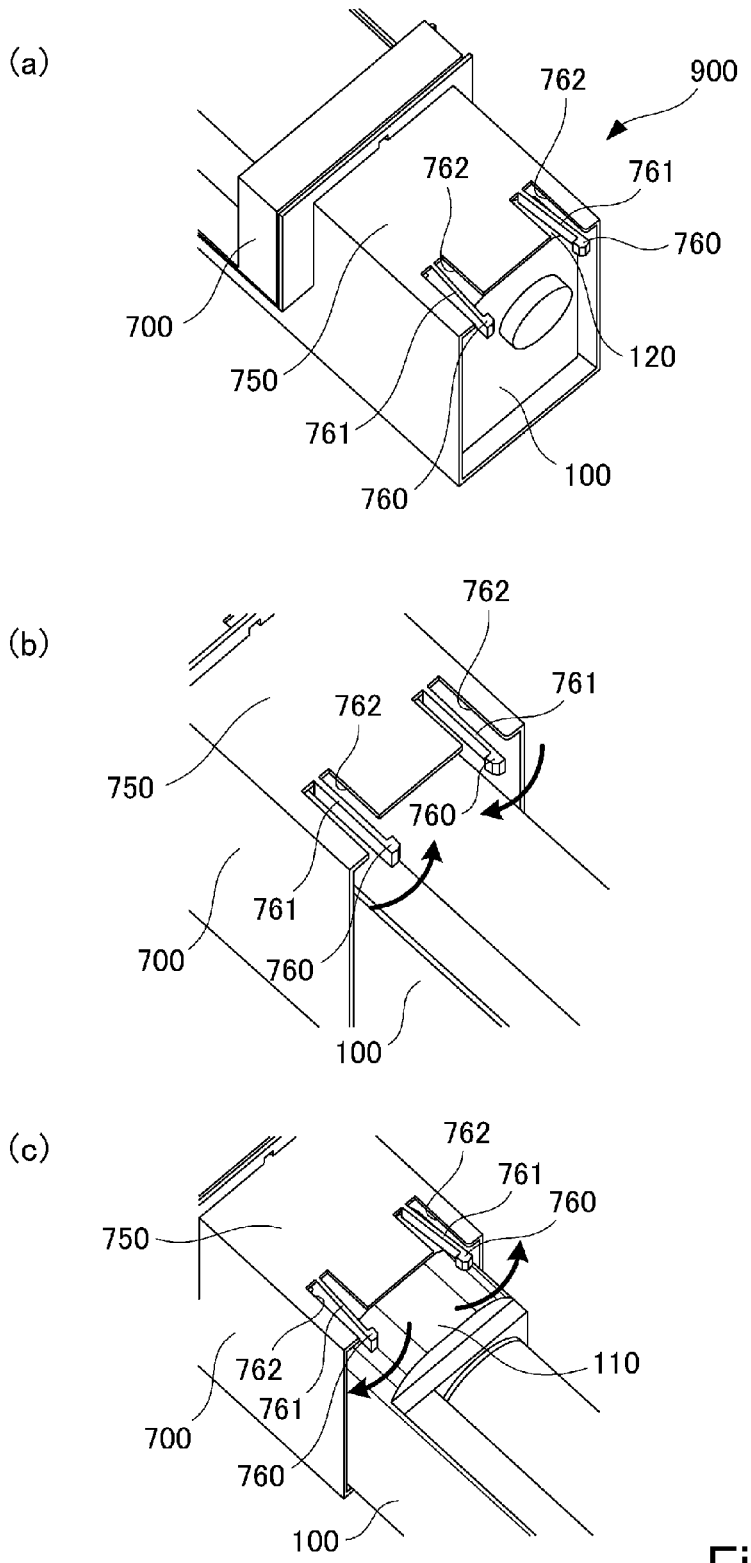

Part (a) of FIG. 28 is a perspective view showing a relation between an elastic deformation portion and the covering member in the state that the insertion of the drum cartridge into the main assembly does not begin in the second embodiment, (b) is a perspective view showing the same during the insertion of the drum cartridge, and (c) is a perspective view of the same immediately before the completion of insertion.

Figure 29:
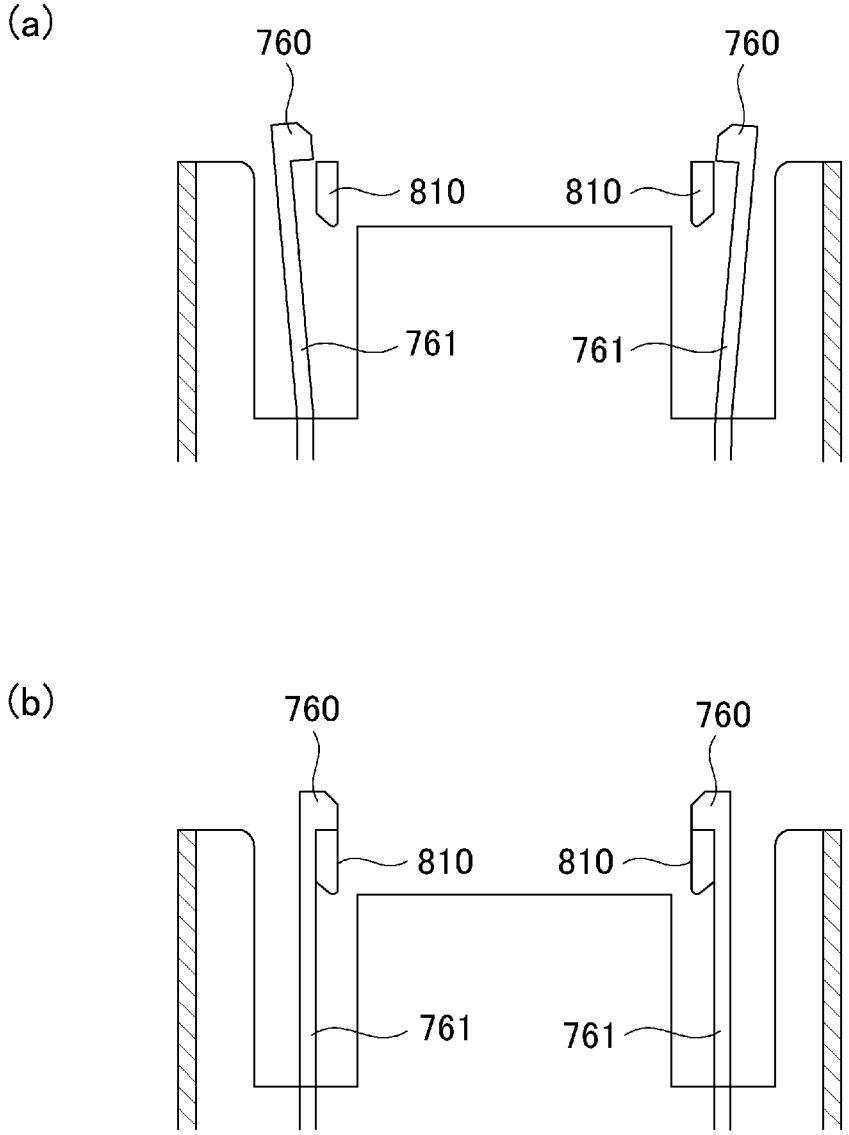

Part (a) of FIG. 29 illustrates a released state between the covering member and the main assembly in the second embodiment, and (b) illustrates a locked state.

Figure 30:
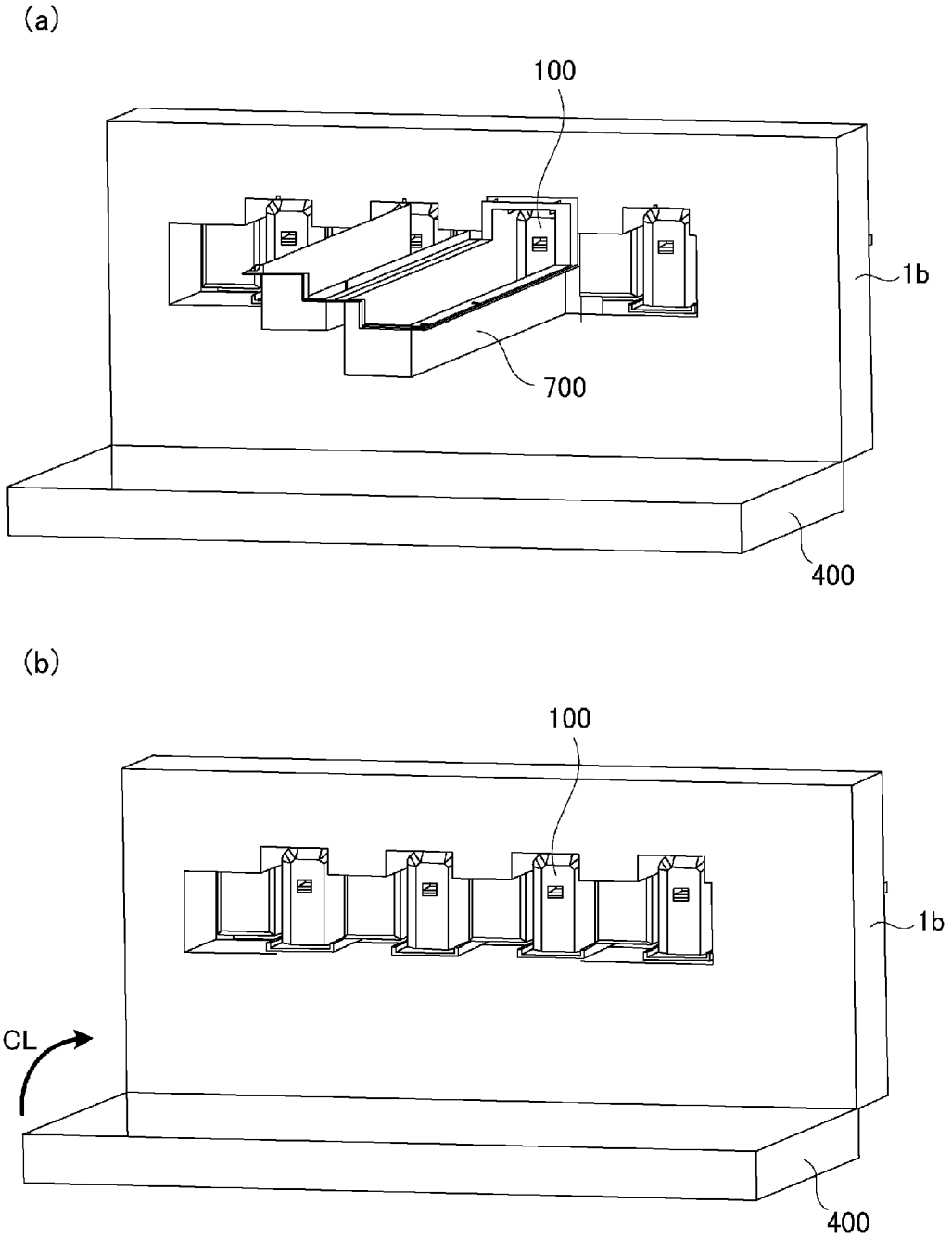

Part (a) of FIG. 30 is a perspective view of a part of the main assembly according to the second embodiment in the state that the drum cartridges mounted to the main assembly, and (b) is a perspective view thereof in the state that the cover member is dismounted from the main assembly.

DESCRIPTION OF THE EMBODIMENTS

First Embodiment

Figure 1:
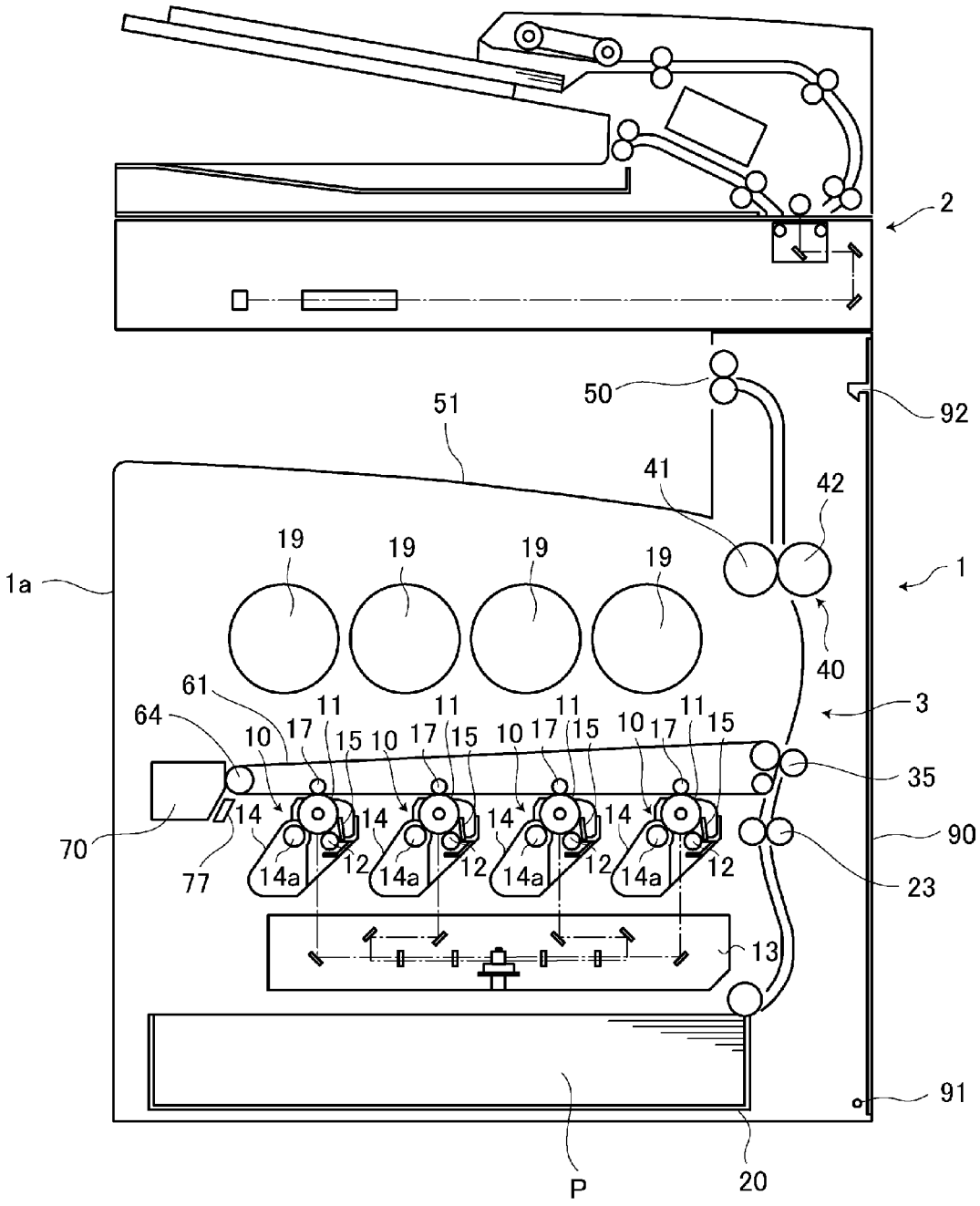
FIG. 1 is a schematic sectional view of an image forming apparatus according to a first embodiment of the present invention. the toner.

Referring to FIG. 1-FIG. 16, a first embodiment of the present invention will be described. Referring first to FIG. 1, a substantial structure of an image forming apparatus of this embodiment will be described.

[Image Forming Apparatus]

The image forming apparatus 1 comprises Y (yellow), M (magenta), C (cyan) and K (black) image forming stations 10. The image forming apparatus 1 of this embodiment is a so-called tandem type in which these image forming stations 10 are arranged in a line along the traveling direction of an intermediary transfer belt 61. In each of the image forming stations 10, the following image forming operations are carried out. A surface of the photosensitive drum (photosensitive member) 11 which is an image bearing member is uniformly charged by a charging roller 12, and thereafter is exposed to image light indicative of image information supplied to the image forming apparatus through a laser scanner 13, so that a latent image is formed on the surface. The image forming apparatus 1 comprises an image reading apparatus 2, and the above-described image information is supplied from the image reading apparatus 2 as the image information read from an original or supplied from an outer terminal such as a personal computer.

The latent image formed on the photosensitive drum 11 is visualized into a toner image by a developing device 14, so that toner images of the respective colors are formed on the photosensitive drums 11. The developing device 14 includes a developing sleeve 14*a* as a developer carrying member which is opposed to the photosensitive drum 11. A predetermined developing bias voltage is applied between the developing sleeve 14*a* and the photosensitive drum 11, when the developing sleeve 14*a* rotates carrying the developer, by which the toner is supplied to the photosensitive drum 11 to develop the latent image with the toner.

The toner image formed on the respective photosensitive drums 11 are sequentially transferred onto the intermediary transfer belt 61 by a predetermined pressure applied by the primary transfer roller 17 and an electrostatic load bias voltage applied to the primary transfer roller 17. A small amount of the toner remaining on the photosensitive drum 11 after transfer operation is removed and collected by the cleaning blade 15, by which the image forming stations are prepared for the next image forming operations. With such structures, the toner in the developing device 14 is consumed, and therefore, the toner is supplied from a toner cartridge 19 into the developing device 14.

On the other hand, a recording material (sheet) P is supplied out of a sheet feeding cassette 20 one by one and is fed to a pair of registration rollers 23. A leading end of the recording material P is stopped by a nip between the registration rollers to form a loop, thus correcting the inclination. Thereafter, the registration rollers start to feed the recording material P in synchronism with the toner image on the intermediary transfer belt 61, into between the intermediary transfer belt 61 and the outer secondary-transfer roller 35. The toner image on the intermediary transfer belt 61 is transferred onto the recording material P by applying a predetermined pressure and an electrostatic load bias voltage to the nip between a driving roller 62 and an outer secondary-transfer roller 35. A small amount of the residual toner remaining on the intermediary transfer belt 61 after transfer operation is removed and collected by a cleaning unit 70 to prepare for the next image forming operation.

The toner image transferred onto the recording material P is fixed on the recording material P by heat pressing in the nip formed between a heating roller 41 and a pressing roller 42 in the fixing device 40. The recording material P carrying the toner image fixed thereon is discharged onto a sheet discharge tray 51 by a pair of sheet discharging rollers. The image forming apparatus 1 of this embodiment is so-called indoor discharge type in which the sheet discharge tray 51 provided between the image reading apparatus 2 and the main assembly 1*a* including the above-described image forming stations 10, the intermediary transfer belt 61, the fixing device 40 and so on.

In this embodiment, a recording material feeding portion 3 is provided at the right side of the image forming apparatus 1 in FIG. 1 to feed the recording material P in the vertical direction. The right side (FIG. 1) of the image forming apparatus 1 is provided with a side surface cover 90 rotatable about a rotational shaft 91 and locked with a part of the main assembly 1*a* by a locking portion 92, so that the side of the main assembly of image forming apparatus is covered. By unlocking the locking portion 92, the side surface cover 90 is openable to open the side of the main assembly 1*a*, and when the recording material is jammed in the recording material feeding portion 3, for example, the side surface cover 90 is opened, by which the user can access the inside of the main assembly 1*a*.

[Drum Cartridge]

In this embodiment, a drum cartridge 100 (unit) including the photosensitive drum 11 (image formation member) for the image formation is detachably mountable to the main assembly 1*a* to permit replacement of the photosensitive drum 11. As shown in parts (a) and (b) of FIG. 2, the drum cartridge 100 includes the photosensitive drum 11, the charging roller 12 and the cleaning blade 15 which are integrally supported by a housing 101. The photosensitive drum 11 and the charging roller 12 are rotatably supported by the housing 101, and the charging roller 12 and the cleaning blade 15 are press-contacted to the photosensitive drum 11.

The photosensitive drum 11, the charging roller 12 and the cleaning blade 15 are deteriorated with image forming operations, and therefore, the drum cartridge 100 as to be replaced depending on the amount of the prints produced by the apparatus using the drum cartridge. Therefore, drum cartridge 100 can be inserted into and pulled out of the main assembly 1*a* in the rear-front direction, and when the service life of the drum cartridge 100 ends, it can be replaced with a fresh one. In this embodiment, the front side of the main assembly 1*a* is in the side where the user operates the image forming apparatus 1. In the following, the inserting direction is the direction of an arrow α in parts (a) and (c) in FIG. 2, that is, the direction of inserting the drum cartridge 100 into the main assembly 1*a*.

By mounting the drum cartridge 100 to the main assembly 1*a*, the photosensitive drum 11 is operably connected through a coupling with a drive transmitting portion of a motor (unshown) which is a driving source provided in the main assembly 1*a*. By this, the photosensitive drum 11 can be driven by the motor. The charging roller 12 is press-contacted to the photosensitive drum 11, and therefore, is rotated by the photosensitive drum 11.

As shown in parts (a)-(c) of FIG. 2, the housing 101 of the drum cartridge 100 is provided with a rib 102 and a guide 103 to be guided by a covering member 200 which will be described hereinafter, during the insertion into the main assembly 1*a*. As shown in parts (a) and (b) of FIG. 2, the rib 102 is projected out from each of the portions adjacent to the opposite ends with respect to the inserting direction of the drum cartridge 101 at one of the side surfaces (left surface of part (b) of FIG. 2). As shown in parts (b) and (c) of FIG. 2, the guide 103 extends substantially in parallel with the inserting direction on the other side surface (right-hand surface in part (b) of FIG. 2) of the housing 101.

On said other side surface of the housing 101 is provided with a locking guide portion 104 in the form of a groove adjacent to the guide 103 and extending in the inserting direction. The locking guide portion 104 (guide portion) is engageable with a projected portion 211 (projection, part (b) of FIG. 3, for example) provided on a swing plate 210 of the covering member 200 which will be described hereinafter to guide the projected portion 211. As shown in part (c) of FIG. 2, a leading end portion of the locking guide portion 104 (right-hand end in part (c) of FIG. 2) with respect to the inserting direction is provided with a locking engaging portion 105 having a dimension in the vertical direction larger than that of the groove of the locking guide portion 104 and having a step between the locking guide portion 104. A trailing end portion of the locking guide portion 104 (left-hand end in part (c) of FIG. 2) with respect to the inserting direction is provided with a release guide portion 106 in the form of a groove inclined upwardly from the locking guide portion 104 toward the rear side. The locking engaging portion 105, the locking guide portion 104 and the release guide portion 106 are formed continuously in the order named. As will be described hereinafter, the locking engaging portion 105, the locking guide portion 104 and the release guide portion 106 are engaged with the projected portion 211, by which a rotational phase of the swing plate 210 is positioned at predetermined positions.

[Covering Member]

In this embodiment, before the drum cartridge 100 is mounted to the main assembly 1*a*, the drum cartridge 100 is provided with the covering member 200 covering at least the photosensitive drum 11 to protect the members including the photosensitive drum 11. As shown in part (a) of FIG. 3, the covering member 200 is elongated in the inserting direction of the drum cartridge 100 (arrow α direction in part (a) of FIG. 3), and has a substantially box shape, the leading end portion side with respect to the inserting direction and a lower side thereof being open. In the following description, the inserting direction is also used with respect to the covering member 200, and the direction is based on the state in which the covering member 200 is mounted to the drum cartridge 100.

As shown in parts (a) and (b), and part (a) of FIG. 4, the covering member 200 includes a top plate portion 201, a first side plate portion 202 and a second side plate portion 203. The first side plate portion 202 and the second side plate portion 203 extend downwardly from the respective widthwise ends (perpendicular to the inserting direction of the drum cartridge 100) from the top plate portion 201. As will be described hereinafter, in this embodiment, the length in the vertical direction of the first side plate portion 202 is longer than that of the second side plate portion 203, so that the side of the drum cartridge 100 where the photosensitive drum 11 facing the developing device 14 is widely exposed is properly covered.

As shown in part (b) of FIG. 3, the first side plate portion 202 is provided on the inner side surface with a drum guide 202*a* in the form of a groove extending in the inserting direction. As shown in part (a) of FIG. 4, the second side plate portion 203 is provided with respective holding ribs 203*a* in the opposite end portions with respect to the inserting direction, on the inner side surface.

In the leading end portion of the covering member 200 with respect to the inserting direction, an inserting portion 204 to be inserted into a predetermined position of the main assembly 1*a* is provided. At the rear side of the inserting portion 204 with respect to the inserting direction, there is provided a contact portion 205 contactable to a part of the main assembly 1*a*, when the cartridge is inserted into the main assembly 1*a*. As shown in part (b) of FIG. 3 and part (a) of FIG. 4, the leading end portion side of the covering member 200 with respect to the inserting direction is open to permit the drum cartridge 100 to be inserted and pulled out. As shown in part (a) of FIG. 3, the trailing end portion side of the covering member 200 with respect to the inserting direction, is covered by a rear side plate 206 so as to connect the rear ends of the second side plate portion 203 and the first side plate portion 202 with each other within the length of the second side plate portion 203.

As shown in part (a) of FIG. 3 and part (b) of FIG. 4, in the leading end portion side of the second side plate portion 203 with respect to the inserting direction, there is provided a swing plate 210 as a movable member. The swing plate 210 is swingable (movable) in the direction indicated by an arrow β in part (b) of FIG. 4 relative to the second side plate portion 203 of the covering member 200 about a swing shaft (unshown) extending perpendicularly to the side surface of the second side plate portion 203. The swing plate 210 has a width measured in the vertical direction in the leading end portion side with respect to the inserting direction, the width being larger than the width measured in the vertical direction in the trailing end portion side.

The leading end portion of the swing plate 210 is provided with a projected portion 211 projecting inwardly of the covering member 200, that is, projecting toward the drum cartridge 100 covered by the covering member 200. The second side plate portion 203 is provided with a through hole 203*b* extending along the swing direction of the swing plate 210 in the area corresponding to the leading end portion of the swing plate 210 with respect to the inserting direction. As shown in part (b) of FIG. 3 and part (a) of FIG. 4, the projected portion 211 provided at the leading end portion of the swing plate 210 projects into the inside of the covering member 200 through the through hole 203*b*. By this, the swing plate 210 is swingable within the range in which the projected portion 211 is movable within the through hole 203*b*. A top end portion of the swing plate 210 adjacent to the trailing end is provided with an engaging portion 212 (locking engaging portion) projecting in the direction away from the second side plate portion 203.

[Mounting of the Drum Cartridge to the Covering Member]

As shown in FIGS. 5 and 6, the covering member 200 having the structure as described above is mounted to the drum cartridge 100. More specifically, the drum cartridge 100 is inserted from the opening of the covering member 200 in the leading end portion side. At this time, as shown in part (b) of FIG. 5, the rib 102 provided on the side surface of the housing 101 of the drum cartridge 100 is engaged with the drum guide 202*a* provided on the inner side surface of the first side plate portion 202 of the covering member 200. In addition, the holding rib 203*a* provided on the inner side surface of the second side plate portion 203 is engaged with the guide 103 provided on the other side surface of the housing 101.

By the engagement of the guides and the ribs, the drum cartridge 100 is inserted into the covering member 200 along the inserting direction. In this manner, in the state that the drum cartridge 100 is mounted to the covering member 200, the space when the photosensitive drum 11 and so on are provided is covered by the top plate portion 201, the first side plate portion 202 and the second side plate portion 203. By this, the photosensitive drum 11 is prevented from being exposed externally.

The drum cartridge 100 and the covering member 200 are locked with each other in the mounted state. Therefore, as shown in FIG. 6, in this mounted the state, the projected portion 211 of the swing plate 210 provided on the covering member 200 is engaged with the locking engaging portion 105 provided on the leading end portion side of said other side surface housing 101 of the drum cartridge 100 with respect to the inserting direction. By this, the drum cartridge 100 is prevented from removing through the opening provided in the leading end portion side of the covering member 200 with respect to the inserting direction. That is, the drum cartridge 100 is not movable relative to the covering member 200 in the direction indicated by the arrow α in FIG. 6. The trailing end portion side of the covering member 200 with respect to the inserting direction is covered by the rear side plate 206, and therefore, the drum cartridge 100 does not remove out of the covering member 200 from the trailing end portion side with respect to the inserting direction.

[Exchange of Drum Cartridge]

The exchange of the drum cartridge 100 in this embodiment will be described. Referring to FIG. 7 through FIG. 9, the operation of pulling the drum cartridge 100 out of the main assembly 1*a* will be described.

[Drum Cartridge Pulling Out]

Parts (a) and (b) of FIG. 7 are schematic views illustrating the structure of the portion of the image forming apparatus 1 where the respective color drum cartridges 100 are mounted, in this embodiment. The main assembly 1*a* is provided in the front side with an openable front cover 400, and as shown in part (a) of FIG. 7, by opening the front cover 400, the drum cartridges 100 can be accessed. In the main assembly 1*a*, the yellow, magenta, cyan and black drum cartridges 100 are placed in this order from the left of the part (a) of FIG. 7. In this embodiment, the drum cartridges 100 have the common structures. The covering members 200 for the drum cartridges 100 also have the common structures. As shown in part (a) of FIG. 7, the developing devices 14 are provided adjacent to the respective drum cartridges 100.

In the following description, the cyan drum cartridge 100 (the third cartridges from the left of part (a) of FIG. 7) is taken, but the same applies to the other drum cartridges. Here, it is assumed that the exchange of the cartridge is requested about the cyan drum cartridge 100 on an unshown display portion (operation panel, for example) or on an external terminal equipment of the image forming apparatus 1. In such a case, an operator such as a user or a service person opens the front cover 400, as shown in part (a) of FIG. 7. Then, as shown in part (b) of FIG. 7, the cyan drum cartridge 100 is pulled out of the main assembly 1*a*.

Here, as shown in FIGS. 8 and 9, the drum cartridge 100 is locked so that it is not removed from the predetermined mounting position in the main assembly 1*a*. As shown in part (a) of FIG. 8, the drum cartridge 100 is placed in the main assembly 1*a* on the guiding rail 410 for guiding the drum cartridge 100. As shown in part (b) of FIG. 8, the guiding rail 410 is provided with the locking claw 411 which is projecting upwardly and which is movable in the vertical direction by elastic deformation. In the state that the drum cartridge 100 is mounted in the predetermined mounting position of the main assembly 1*a*, the locking claw 411 is engaged with an engaging hole 16*a* provided in a predetermined position of the lower surface of the drum cartridge 100, as shown in FIG. 9.

As shown in FIG. 9, a releasing member 16*b* is provided in the engaging hole 16*a*. The releasing member 16*b* is movable along the engaging hole 16*a* extending in the vertical direction, and is provided with an operation lever 16*c* which is exposed in the front side of the drum cartridges 100 to be openable by the operator. When the operator lowers the operation lever 16*c* in the direction indicated by an arrow γ in FIG. 9, the releasing member 16*b* lowers together with the locking claw 411, by which the locking claw 411 is disengaged from the engaging hole 16*a*. By this, the drum cartridge 100 is unlocked, so that the drum cartridge 100 can be pulled out of the main assembly 1*a* in the direction indicated by an arrow δ in FIG. 9.

After the drum cartridge 100 is pulled out, the protection of the drum cartridge 100 does not require to be handled carefully because it has been used up. The removed drum cartridge 100 is collected by the service person or another operator. When the drum cartridge 100 is pulled out, the covering member 200 may be mounted to the insertion position of the main assembly 1*a* which will be described hereinafter so that the drum cartridge 100 is guided into the covering member 200. By doing so, the operator is protected from contamination with toner or the like on the photosensitive drum 11, for example.

[Mounting of Drum Cartridge]

Referring to FIG. 10 through FIG. 15, the mounting operation of the drum cartridge 100 into the main assembly 1*a* will be described. First, as shown in part (a) of FIG. 10, the operator places a fresh drum cartridge 100 covered by the covering member 200 in the insertion position of the main assembly 1*a*. As shown in part (b) of FIG. 10, the drum cartridge 100 is moved in the inserting direction relative to the covering member 200 into the main assembly 1*a*.

Here, as shown in FIG. 11, a receiving portion 300 of the main assembly 1*a* through which the drum cartridge 100 is inserted is provided with a supporting portion 301 engageable the inserting portion 204 provided in the leading end portion of the covering member 200 with respect to the inserting direction. The supporting portion 301 of the main assembly 1*a* supports the covering member 200 and the drum cartridge 100 in the state that the drum cartridge 100 covered by the covering member 200 has been inserted by a predetermined amount from the insertion position of the main assembly 1*a*.

More specifically, the supporting portion 301 is recessed upwardly in the receiving portion 300 and has a predetermined length in the inserting direction, and it is provided with a support surface 302 at the top and with a guiding rib 304 extending in the inserting direction on each of side walls 303 provided at opposite widthwise end portions. In addition, one (right side one in FIG. 11) of the guiding ribs 304 is provided at an end portion in the drum cartridge 100 receiving side (left-hand end portion in part (a) of FIG. 12) with a projection 305 projecting downwardly.

On the other hand, as shown in parts (a) of FIG. 3 and FIG. 12, the inserting portion 204 of the covering member 200 is provided with a contact surface 204*a* and an engaging rib 204*b*. The contact surface 204*a* abuts to the support surface 302 in the state that the covering member 200 is inserted into the main assembly 1*a*. The engaging ribs 204*b* are placed on the respective guiding ribs 304 and are engageable with the guiding rib 304.

When the drum cartridge 100 covered by the covering member 200 is inserted toward the insertion position of the main assembly 1*a*, the inserting portion 204 of the covering member 200 is inserted into the supporting portion 301 of the main assembly 1*a*. In this state, the contact surface 204*a* abuts to the support surface 302, and the engaging ribs 204*b* are supported by the guiding ribs 304, so that the covering member 200 is guided toward the insertion position.

[First Step]

As shown in part (a) of FIG. 12, in the state that the covering member 200 has been inserted by a predetermined amount Y, the engaging portion 212 of the swing plate 210 of the covering member 200 contacts the front side of the projection 305 of said one of the guiding ribs 304. Here, the front side of the projection 305 is the side where the covering member 200 and the drum cartridge 100 are inserted and is a side close to the front side of the main assembly 1*a*. A rear surface of the projection 305 which will be described hereinafter is a back side of the front side and is a rear side surface with respect to the main assembly 1*a*.

Here, a clearance X between the support surface 302 and the upper surface of the guiding rib 304 is slightly larger than the clearance between the contact surface 204*a* and the lower surface of the engaging rib 204*b*, and therefore, the play between the inserting portion 204 and the supporting portion 301 is small. Therefore, in the state that the inserting portion 204 has been inserted into the supporting portion 301 by the predetermined amount Y, the drum cartridge 100 cover by the covering member 200 is supported by the main assembly 1*a*. That is, even if the operator hands off the covering member 200 and the drum cartridge 100, they do not fall from the main assembly 1*a*.

[Second Step]

Then, when the covering member 200 and the drum cartridge 100 are further inserted from the position shown in part (a) of FIG. 12, the swing plate 210 of the covering member 200 starts to rotate in the direction indicated by an arrow β1 by the engagement between the engaging portion 212 and the projection 305, as shown in part (b) of FIG. 12. In the state shown in part (a) and (b) of FIG. 12, the projected portion 211 of the swing plate 210 keeps engagement with the locking engaging portion 105 of the drum cartridge 100 as shown in FIG. 6, and therefore, the drum cartridge 100 is locked with the covering member 200.

[Third Step]

The covering member 200 and the drum cartridge 100 are further inserted, then, as shown in part (a) of FIG. 13, and the swing plate 210 rotates in the direction of the arrow β1, so that the engaging portion 212 passes below the projection 305. At this time, the contact portion 205 of the covering member 200 abuts to the surface 306 which is a part of the main assembly 1*a*, so that the covering member 200 is not inserted any further. In this state, the covering member 200 and the drum cartridge 100 are placed in the insertion position of the main assembly 1*a*. In addition, as shown in part (b) of FIG. 13, the projected portion 211 is disengaged from the locking engaging portion 105, so that the drum cartridge 100 is unlocked from the covering member 200. By this, the drum cartridge 100 becomes movable in the inserting direction relative to the covering member 200.

That is, in the case of this embodiment, when the drum cartridge 100 covered by the covering member 200 is placed in the insertion position (the position depicted in part (a) of FIG. 13), the locking between the drum cartridge 100 and the covering member 200 is released. In this manner, this embodiment includes a unit locking mechanism 500 as unit locking means for locking and unlocking between the drum cartridge 100 and the covering member 200. The unit locking mechanism 500 comprises the engaging portion 212, the projection 305 as the portion-to-be-engaged, the swing plate 210 as the movable member, the projected portion 211 and the locking engaging portion 105.

As described hereinbefore, the engaging portion 212 is provided on the covering member 200. The projection 305 as the portion-to-be-engaged is provided in the main assembly 1*a* and is engageable with the engaging portion 212. The swing plate 210 as the movable member is provided with the engaging portion 212 and is movable (swingable) relative to the covering member 200. The projected portion 211 is provided on the swing plate 210 and is projected toward the drum cartridge 100 covered by the cover member 200. The locking engaging portion 105 is engageable with the projected portion 211 and locks between the drum cartridge 100 and the covering member 200 by the engagement with the projected portion 211. On the other hand, when the drum cartridge 100 covered by the covering member 200 is placed in the insertion position, the locking engaging portion 105 is disengaged from the projected portion 211 by the engaging portion 212 engaging with the projection 305.

As shown in part (b) of FIG. 13, above the locking engaging portion 105, a releasing portion 105*a* recessed upwardly beyond the locking guide portion 104 is provided. Therefore, the projected portion 211 is movable upwardly of the position of the locking guide portion 104, and correspondingly, the swing plate 210 Is swingable in the direction of the arrow β1. As a result, the position of the engaging portion 212 can be lowered relative to the projection 305, by which the engagement and disengagement therebetween is further assured.

As described in the foregoing, the drum cartridge 100 released from the covering member 200 by the releasing between the projected portion 211 and the locking engaging portion 105 can be inserted into the main assembly 1*a* while being guided by the covering member 200. That is, as shown in part (b) of FIG. 5, the rib 102 of the drum cartridge 100 is engaged with the drum guide 202*a* of the covering member 200, and the holding rib 203*a* of the covering member 200 is engaged with the guide 103 of the drum cartridge 100. By the engagement, the drum cartridge 100 can be inserted into the main assembly 1*a* while being guided by the covering member 200.

[Fourth Step]

When only the drum cartridge 100 is inserted toward the mounting position in the main assembly 1*a* from the insertion position through a first predetermined amount, the swing plate 210 rotates in the direction indicated by an arrow β2 which is the opposite direction to the arrow β1 direction, as shown in part (a) of FIG. 14. At this time, the contact portion 205 of the covering member 200 contacts to the surface-to-be-contacted 306 which is a part of the main assembly 1*a*, so that the covering member 200 is not inserted any further. By this, the engaging portion 212 having passed by the projection 305 is placed to a position where it is engageable with the rear surface of the projection 305.

Thus, when the drum cartridge 100 is inserted from the insertion position by the first predetermined amount, the projected portion 211 of the swing plate 210 is moved relative to the drum cartridge 100, and the projected portion 211 is brought into engagement with the locking guide portion 104, as shown in part (b) of FIG. 14. At this time, the projected portion 211 disposed above the locking guide portion 104 by the releasing portion 105*a* is guided by an inclined portion 105*b* provided between the releasing portion 105*a* and the upper surface of the locking guide portion 104, by which it is brought into engagement with the locking guide portion 104. As a result, the swing plate 210 strings in the direction indicated by the arrow β2 as shown in part (a) of FIG. 14, so that the engaging portion 212 moves to the position where it is engageable with the projection 305. And, the covering member 200 is locked with the main assembly 1*a*, so that the covering member 200 is prevented from removing from the main assembly 1*a*.

In this manner, in this embodiment, a main assembly locking mechanism (moving mechanism) 600 as main assembly locking means for effecting locking and unlocking between the main assembly 1*a* and the covering member 200 is provided. The main assembly locking mechanism 600 includes an engaging portion (locking engaging portion) 212 and a projection 305 as the portion-to-be-engaged. When the drum cartridge 100 is inserted from the insertion position by the first predetermined amount (distance), the main assembly locking mechanism 600 causes the engagement between the engaging portion 212 and the projection 305. On the other hand, as will be described hereinafter, the main assembly locking mechanism 600 causes of disengagement between the engaging portion 212 and the projection 305, when the drum cartridge 100 is inserted by a second predetermined amount from the insertion position.

More particularly, the main assembly locking mechanism 600 also includes the swing plate (locking portion) 210 as the movable member, the projected portion 211, the locking guide portion (guide portion) 104 and the release guide portion 106. The locking guide portion 104 is extended substantially in parallel with the inserting direction in the range of movement of the drum cartridge 100 relative to the covering member 200 between the position corresponding to the first predetermined amount to the position corresponding to the second predetermined (not including the position corresponding to the second predetermined). The locking guide portion 104 guides and engages with the projected portion 211 such that when the drum cartridge 100 move in the range, the swing plate 210 is retained in an engaging position for the engagement between the engaging portion 212 and the projection 305. On the other hand, the release guide portion 106 guides and engages with the projected portion 211 such that when the drum cartridge 100 is moved to the position corresponding to the second predetermined, the swing plate 210 moves to a release position where the engagement between the engaging portion 212 and in the projection 305 is released. This will be described hereinafter.

In this manner, in this embodiment, the main assembly locking mechanism 600 include the engaging portion 212, the projection 305 as the portion-to-be-engaged, the swing plate 210 as the movable member and the projected portion 211, in common with the above-described unit locking mechanism 500. The locking guide portion 104 and the release guide portion 106 are grooves continuous with the locking engaging portion 105. Therefore, the main assembly locking mechanism 600 and the unit locking mechanism 500 have the common structures as for the mechanism.

Here, even if an attempt is made to remove the covering member 200 from the main assembly 1*a* in the state that the covering member 200 is locked with the main assembly 1*a*, it cannot be removed. That is, in this state, the engagement between the engaging portion 212 and the rear surface of the projection 305 is maintained by limiting the swing motion of the swing plate 210 by the engagement between the projected portion 211 and the locking guide portion 104, as shown in part (b) of FIG. 14. Therefore, it is not possible to pull the covering member 200 out of the main assembly 1*a*.

On the other hand, when the drum cartridge 100 having been inserted from the insertion position beyond the first predetermined amount position is returned to the insertion position, the locking between the main assembly 1*a* and the covering member 200 is released. That is, when the drum cartridge 100 is returned to the insertion position, the projected portion 211 is moved into the region of the locking engaging portion 105 provided in the leading end portion side of the locking guide portion 104 with respect to the inserting direction, as shown in part (b) of FIG. 13. As a result, the swing plate 210 becomes capable of the swing in the arrow β1 direction, and as shown in part (a) of FIG. 13, the engagement between the engaging portion 212 and the projection 305 is released, so that the covering member 200 is unlocked from the main assembly 1*a*. Therefore, by returning the drum cartridge 100 to the insertion position, the covering member 200 and the drum cartridge 100 can be removed from the main assembly 1*a*.

The first predetermined amount (distance) may be a distance by which the drum cartridge 100 is capable of even slightly moving relative to the covering member 200 from the insertion position shown in part (a) of FIG. 13. That is, it will suffice if the covering member 200 is locked with the main assembly 1*a* by the pressing only the drum cartridge 100 from the position where the drum cartridge 100 and the covering member 200 are set in the insertion position. In other words, it will suffice if the covering member 200 is not locked with the main assembly 1*a* even when only the drum cartridge 100 is slightly moved in the inserting direction by the momentum upon the setting of the drum cartridge 100 and the covering member 200 in the insertion position by the operator. Therefore, the first predetermined amount is selected so as to be larger than the play between the locked drum cartridge 100 and the covering member 200 in the inserting direction.

[Fifth Step]

When only the drum cartridge 100 is further inserted toward the mounting position in the main assembly 1*a* from this position, the swing plate 210 rotates in the direction indicated by the arrow β1, as shown in part (a) of FIG. 15. Then, the engaging portion 212 of the swing plate 210 is placed below the projection 305 (release position) to release the engagement. As a result, the covering member 200 is unlocked from the main assembly 1*a* so that the covering member 200 can be removed from the main assembly 1*a*.

That is, by inserting the drum cartridge 100 by the second predetermined amount larger than the first predetermined amount from the insertion position, the projected portion 211 of the swing plate 210 is moved relative to the drum cartridge 100, as shown in part (b) of FIG. 15. And, the projected portion 211 is brought into engagement with the release guide portion 106. As described hereinbefore, the release guide portion 106 is inclined upwardly toward the rear side beyond the locking guide portion 104 in the inserting direction, and therefore, the swing plate 210 is rotated in the arrow β1 direction while the projected portion 211 is engaged with and guided by the release guide portion 106. As a result, as shown in part (a) of FIG. 15, the swing plate 210 swings in the arrow β1 direction to move to such a position that the engaging portion 212 does not engage with the projection 305.

In addition, the guide 103 and the release guide portion 106 provided at the other side (right side in part (b) of FIG. 2) of the housing 101 of the drum cartridge 100 are open to the trailing end portion of the other side with respect to the inserting direction. As shown in part (a) of FIG. 2, the both side surfaces of the housing 101 are contained yesterday with the trailing edge surface and the inclined surface 101*a* with respect to the inserting direction. The pair of inclined surfaces 101*a* are inclined toward each other as the distance toward the trailing end portion decreases. Therefore, as shown in part (a) of FIG. 2, the guide 103 and the release guide portion 106 enter to the inclined surface 101*a* by the depth thereof.

By this, the holding rib 203*a* and the projected portion 211 engaging with the guide 103 and the release guide portion 106, respectively, can be out of the guide 103 and the release guide portion 106 toward the rear side with respect to the inserting direction. As shown in part (a) of FIG. 4, the drum guide 202*a* of the covering member 200 is also open to the front side of the covering member 200 with respect to the inserting direction. Therefore, the rib 102 of the drum cartridge 100 engaging therewith can be out of the drum guide 202*a* toward the front side with respect to the inserting direction. In this manner, the covering member 200 can be taken out of the drum cartridge 100, too, when the covering member 200 is removed from the main assembly 1*a*. That is, when the drum cartridge 100 is inserted by the second predetermined amount, it can be taken out of the main assembly 1*a* and out of the drum cartridge 100.

The above-described second amount may preferably correspond to a distance until the drum cartridge 100 is inserted to the predetermined mounting position of the main assembly 1*a*. In the insertion position, as shown in FIGS. 8 and 9, the locking claw 411 of the main assembly 1*a* is engaged with the engaging hole 16*a* of the drum cartridge 100, so that the drum cartridge 100 is locked with the main assembly 1*a*. Therefore, when the covering member 200 is removed from the main assembly 1*a*, the drum cartridge 100 is prevented from unintentionally being pulled out.

However, the second predetermined amount may correspond to the position where the gravity center of the drum cartridge 100 comes in the main assembly 1*a*. That is, if the gravity center of the drum cartridge 100 is on the guiding rail 410 of the main assembly 1*a*, the drum cartridge 100 is not unintentionally removed from the main assembly 1*a* even if the covering member 200 is removed. In the case that the drum cartridge 100 includes the photosensitive drum 11 therein as in this embodiment, the second predetermined amount may correspond to the position where the photosensitive drum 11 is positioned in place in the main assembly. That is, if the photosensitive drum 11 is in the main assembly 1*a*, the photosensitive drum 11 is not easily exposed to an outside even if the cover member 200 is removed, and therefore, the damage or the exposure of the photosensitive drum 11 can be avoided in the inserting operation, even if the cover member 200 is removed.

In any case, the covering member 200 is removed from the main assembly 1*a* and from the drum cartridge 100, after the drum cartridge 100 is inserted from the insertion position by the second predetermined amount. In this embodiment, the covering member 200 is removed after the drum cartridge 100 is inserted to the predetermined mounting position. As a result, as shown in part (a) of FIG. 16, the drum cartridge 100 is inserted to the predetermined mounting position, and thereafter, as shown in part (b) of FIG. 16, the front cover 400 is closed, by which the exchanging operation of the drum cartridge 100 is completed.

As described in the foregoing, in this embodiment, the drum cartridge 100 is correctly positioned to the insertion position of the main assembly 1*a* in the state that it is protected by the covering member 200, and thereafter, the drum cartridge 100 is inserted into the main assembly 1*a*. Therefore, the inserting operation into the main assembly 1*a* can be carried out without damaging a member such as the photosensitive drum 11 in the drum cartridge 100. In the state before the mounting, the covering member 200 and the drum cartridge 100 are locked with each other by the unit locking mechanism 500, And therefore, the covering member 200 is not inadvertently dismounted from the drum cartridge 100.

In this embodiment, in the state in which the drum cartridge 100 it is set in the insertion position of the main assembly 1*a*, the drum cartridge 100 may be removed. That is, as shown in part (a) of FIG. 13, the engaging portion 212 provided on the swing plate 210 of the covering member 200 is not engaged with the projection 305 provided on the main assembly 1*a*, in the insertion position. For this reason, in the state in which the drum cartridge 100 and the covering member 200 are set in the insertion position, there can be easily removed from the main assembly 1*a*. Therefore, even in the case that the drum cartridge 100 set in the insertion position of the main assembly 1*a* erroneously, it can be removed without the inserting operation of the drum cartridge 100, as is different from the case of Japanese Laid-open Patent Application 2007-240661 discussed hereinbefore.

In addition, in the case of this embodiment, when the drum cartridge 100 is inserted buy the first predetermined amount from the insertion position, the covering member 200 and the main assembly 1*a* are locked with each other. In addition, the cover member 200 is not unlocked from the main assembly 1*a* until the drum cartridge 100 is inserted by the second predetermined amount. Therefore, the covering member 200 is not unintentionally disengaged from the main assembly 1*a* during inserting operation of the drum cartridge 100, and the drum cartridge 100 can be inserted to the predetermined mounting position while being guided by the covering member 200.

For example, if the covering member 200 can be unlocked from the main assembly 1*a* at any time as with the case of Japanese Laid-open Patent Application 2010-78703, there is a possibility that the operator may inadvertently dismounted the covering member 200 from the main assembly 1*a* during the inserting operation of the drum cartridge 100. If this occurs, the drum cartridge 100 is not guided by the cover member 200, and therefore, the inserting operation is not carried out smoothly. In this embodiment, the second predetermined amount corresponds at least to the position where the gravity center of the drum cartridge 100 is in the main assembly 1*a*, and therefore, even if the covering member 200 it unlocked from the main assembly 1*a* in such a state, the drum cartridge 100 is not let fall. Thereafter, the drum cartridge 100 can be inserted smoothly while being guided by the guiding rail 410 of the main assembly 1*a*.

In addition, in the case of this embodiment, the locking between the covering member 200 and the drum cartridge 100 is released by placing the covering member 200 and the drum cartridge 100 in the insertion position. For this reason, the locking between the covering member 200 and the drum cartridge 100 can be released without any particular operation for the releasing.

Furthermore, if a malfunction of the unit locking mechanism 500 for releasing the locking between the covering member 200 and the drum cartridge 100 occurs, the covering member 200 and the drum cartridge 100 cannot be placed in the insertion position. For example, if the swing plate 210 is clogged to be non-rotatable, the swing plate 210 does not rotate even if the engaging portion 212 and the projection 305 are engaged with each other, and therefore, the covering member 200 cannot be placed in the insertion position. In addition, even if the covering member 200 can be placed in the insertion position, the drum cartridge 100 cannot be inserted by the first predetermined amount if the locking between the covering member 200 and the drum cartridge 100 is not released. Therefore, the locking between the covering member 200 and the main assembly 1*a* is not possible. In any case, even if the malfunction of the unit locking mechanism 500 occurs, the locking of the covering member 200 with the main assembly 1*a* can be prevented, and therefore, it can be dismounted from the main assembly 1*a*.

In this embodiment, the main assembly locking mechanism 600 and the unit locking mechanism 500 have the common structures. Therefore, the number of parts can be reduced as compared with the case of respective mechanisms. The main assembly locking mechanism 600 and the unit locking mechanism 500 effect the locking and unlocking in interrelation with the setting of the covering member 200 and the drum cartridge 100 in the insertion position and the inserting operation of the drum cartridge 100, respectively. That is, in this embodiment, the locking and unlocking of the locking mechanisms can be effected only by the setting and inserting operations of the drum cartridge 100 relative to the main assembly 1*a*. Therefore, the mounting operation of the drum cartridge 100 to the main assembly 1*a* can be carried out easily without particularly operation for the locking and unlocking.

In the foregoing description, the main assembly locking mechanism 600 and the unit locking mechanism 500 have the common structures, but they may be respective mechanisms. In this embodiment, the locking and unlocking of the locking mechanism is carried out by swing the swing plate 210, but a slidable member is usable in place of the swing plate. In such a case, the slidable member slides in the vertical direction along the locking engaging portion 105, the locking guide portion 104 and the release guide portion 106.

Second Embodiment

Referring to FIG. 17 to FIG. 30, a second embodiment will be described. In this embodiment, a covering member 700 covering the drum cartridge 100 and the structure for the locking and unlocking relative to the main assembly 1*b* are different from those of the first embodiment. In the description of this embodiment, the same reference numerals as in Embodiment 1 are assigned to the elements having the corresponding functions in this embodiment, and the detailed description thereof is omitted for simplicity.

[Covering Member].

As shown in parts (a) and (b) of FIG. 17, the covering member 700 is provided in the upper portion with a closing member portion 710 and is provided in the lower portion with an accommodating portion 720, wherein the closing member portion 710 is capable of opening and closing the accommodating portion 720. At the leading end portion side of the covering member 700 with respect to the inserting direction, a relaying opening 740 for relaying the drum cartridge 100 from the covering member 700 to the main assembly 1*b* is provided. An outer periphery of the member forming the relaying opening 740 functions as an engaging portion 750 engageable with an opening 800 (receiving portion, part (a) of FIG. 23) which is a receiving port of the main assembly 1*b* for the drum cartridge 100. In addition, the upper portion of the engaging portion 750 is provided with an engaging portion 760 for engagement with a projection 810 of the main assembly 1*b* (part (a) of FIG. 29).

In this embodiment, the closing member portion 710 and the accommodating portion 720 of the covering member 700 is made of integrally molded resin material which is black polypropylene resin material, for example. As shown in part (a) of FIG. 18, the closing member portion 710 is capable of opening and closing relative to the accommodating portion 720 by a living hinge 730. As shown in part (b) of FIG. 18, the neighborhood of the portion which becomes a gap when the closing member portion 710 closes the accommodating portion 720, a member 711 is provided to prevent the light directly reaches to the inside of the covering member 700.

As shown in parts (a) and (b) of FIG. 19, the closing member portion 710 is provided with a snap-fit 712 and a hook 713, and in the state that the closing member portion 710 is closed, they are engaged with the accommodating portion 720. By this, the closing member portion 710 is locked to the accommodating portion 720. As shown in part (a) of FIG. 20, the hook 713 is capable of elastically deforming to enter through the opening 721 formed on the accommodating portion 720. And, by the engagement of the hook 713 with the peripheral portion of the opening 721, the closing member portion 710 is locked in the closing state for the accommodating portion 720. The hook 713 is not disengaged except when the closing member portion 710 is moved relative to the accommodating portion 720 toward the rear side (the direction indicated by an arrow R, toward the leading side with respect to the inserting direction, rightward, in part (b) of FIG. 19).

As shown in part (b) of FIG. 20, the snap-fit 712 is capable of elastically deforming to enter through the opening 722 formed on the accommodating portion 720. By the engagement between the snap-fit 712 and the periphery of the opening 722, the closing member portion 710 is locked in the state of closing the accommodating portion 720. The snap-fit 712 can be disengaged from the periphery of the opening 722 by the formation thereof by receiving a force toward the front side relative to the accommodating portion 720 (the direction indicated by an arrow F, toward the rear side with respect to the inserting direction, leftward in part (b) of FIG. 19).

In this embodiment, in the state that the closing member portion 710 is closed, all of the snap-fit 712 and the hook 713 are engaged with a part of the accommodating portion 220, and therefore, the closing member portion 710 is not easily opened. On the other hand, in the state that the snap-fit 712 is disengaged from the accommodating portion 220 by the application of the force in the arrow F direction, only the rear side opens with the result of inclination of the closing member portion 710 when the closing member portion 710 is opened. In this state, the hook 713 move in the arrow R direction, and the closing member portion 710 can be opened.

[Mounting of the Drum Cartridge to the Covering Member]

As shown in FIGS. 21 and 22, the covering member 700 having the structure as described above is mounted to the drum cartridge 100. More particularly, the drum cartridge 100 placed in the accommodating portion 720 with the closing member portion 710 open is shown. By this, the drum cartridge 100 becomes accommodated in the covering member 700, in which the drum cartridge 100 is covered by the covering member 700. In this state, the end portion covering member 770 is engaged with the engaging portion 750 provided at the leading end portion side with respect to the inserting direction (right side in FIG. 21).

The end portion covering member 770 is made of foam material and is engaged with the engaging portion 760 of the covering member 700 using the elasticity of the foam material. By doing so, the relaying opening 740 is closed by the end portion covering member 770, and the entirety of the drum cartridge 100 is covered by the covering member 700 and the end portion covering member 770. As shown in FIG. 22, a stopper portion 714 is provided in the trailing end portion side of the closing member portion 710 with respect to the inserting direction. In the state that the closing member portion 710 is closed, the stopper portion 714 contacts the leading end surface of the projected portion 110 with respect to the inserting direction, the projected portion 110 projecting upwardly at the rear end with respect to the drum cartridge 100. By this, the movement of the drum cartridges 100 toward the leading end portion with respect to the inserting direction within the covering member 700 can be prevented. Therefore, without the end portion covering member 770, the drum cartridge 100 is prevented from ejecting through the relaying opening 740 of the covering member 700.

As shown in part (a) of FIG. 28 which will be described hereinafter, a part of the drum cartridge 100 contacts the engaging portion 760 to elastically expand the engaging portion 760. In such a state, the drum cartridge 100 is protected by the covering member 700 and the end portion covering member 770. The package type during the transportation of the drum cartridge 100 may include the covering member 700, and a buffering member of foam material, a protection bladder, a corrugated box similarly to a conventional package.

[Exchange of Drum Cartridge]

The exchange of the drum cartridge 100 in this embodiment will be described. In the following description, the cyan drum cartridge 100 (the third cartridges from the left of part (a) of FIG. 23) is taken, but the same applies to the other drum cartridges. Similarly to the first embodiment, the drum cartridge 100 is pulled out of the main assembly 1*b* (part (a) of FIG. 23). As shown in part (b) of FIG. 23, a fresh drum cartridge 100 covered by the covering member 700 is inserted into the insertion position of the main assembly 1*b*.

At this time, as shown in parts (a) of FIG. 24, the end portion covering member 770 is removed from the covering member 700. As has been described in conjunction with FIG. 22, the stopper portion 714 of the covering member 700 contacts the projected portion 110 of the drum cartridge 100. Therefore, even if the end portion covering member 770 is removed, the drum cartridge 100 is not this engaged from the covering member 700 before the drum cartridge 100 is positioned in place in the main assembly 1*a*.

Then, the drum cartridge 100 covered by the covering member 700 is inserted to the insertion position of the main assembly 1*b*. At this time, as shown in FIG. 25, the engaging portion 750 of the covering member 700 is engaged with the opening 800 of the main assembly 1*b*. The end portion covering member 770 has a size larger than the opening 800, and therefore, the covering member 700 cannot be inserted through the opening 800 if the end portion covering member 770 is kept mounted.

The opening 800 as the supporting portion functions so that the covering member 700 and the drum cartridge 100 are supported by the main assembly 1*b* in the state that the drum cartridge 100 covered by the covering member 700 is inserted toward the insertion position of the main assembly 1*b* by a predetermined amount. That is, as shown in FIG. 25, the engaging portion 750 of the covering member 700 is engaged with the opening 800 of the main assembly 1*b* without play, and the engagement width Y thereof is 50 mm, for example. By this, the drum cartridge 100 covered by the covering member 700 is supported by the main assembly 1*b*. That is, even if the operator hands off the covering member 700 and the drum cartridge 100, they do not fall from the main assembly 1*a*. In this embodiment, this position is the insertion position of the drum cartridge 100 relative to the main assembly 1*b*.

As shown in FIG. 26, a projection 801 is provided in the upper side of the opening 800 on the surface at the front side (left side of FIG. 26) of the main assembly 1*b* so as to project toward the front side. On the other hand, an opening 723 is provided in the portion opposed to the snap-fit 712 of the closing member portion 710 in a part of the accommodating portion 720 of the covering member 700. In this state is that the covering member 700 and the drum cartridge 100 are set in the insertion position of the main assembly 1*b*, the projection 801 pushes the snap-fit 712 through the opening 723 in the direction indicated by the arrow F. By this, the snap-fit 712 is disengaged. By this, as described hereinbefore, the closing member portion 710 of the covering member 700 becomes openable.

Then, as shown in part (a) of FIG. 27, the closing member portion 710 is opened. By this, the operator can access to the drum cartridge 100. At this time, the engagement between the stopper portion 714 and the projected portion 110 which has been described in conjunction with FIG. 22 is released, so that the drum cartridge 100 becomes movable in the inserting direction relative to the covering member 700. In this state, as shown in part (b) of FIG. 27, the drum cartridge 100 is inserted toward a predetermined mounting in the main assembly 1*b*. At this time, the insertion of the drum cartridge 100 is guided by the covering member 700. More particularly, as shown in FIG. 21, the drum cartridge 100 is placed on the bottom portion 701 of the covering member 700 and is guided by the bottom portion 701 as the guide portion. The operator is capable of looking at both of the drum cartridge 100 and the covering member 700, and therefore, can easily insert the drum cartridge 100. By opening the closing member portion 710 after the position regulation in the insertion position of the main assembly 1*b*, the photosensitive drum 11 is protected from exposure or damage until immediately before the insertion of the drum cartridge 100.

[Main Assembly Locking Mechanism]

Referring to FIGS. 28 and 29, the description will be made as to a main assembly locking mechanism (moving mechanism) 900 for locking and unlocking between the covering member 700 and the main assembly 1*b* in this embodiment. The main assembly locking mechanism 900 of this embodiment includes an engaging portion (inserting portion, locking portion) 760, and a projection 810 as a portion-to-be-engaged. The engaging portion 760 is provided on the covering member 700, and a pair of projections 810 is provided on the main assembly 1*b* and is engageable with the engaging portion 760. In this embodiment, the engaging portion 760 functions to engage and lock with the main assembly 1*b*. The pair of projections 810 are provided on the upper surface the surface around the opening 800 of the main assembly 1*b* with which the engaging portion 750 of covering member 700 engages and projects downwardly. When the drum cartridge 100 is inserted from the insertion position by a first predetermined insertion, the engaging portion 760 and the projection 810 are engaged with each other, by which the main assembly 1*b* and the covering member 700 are locked with each other. On the other hand, when the drum cartridge 100 is inserted from the insertion position by a second predetermined amount, the engaging portion 760 Is disengaged from the projection 810, by which the covering member 700 is unlocked from the main assembly 1*b*.

More particularly, the main assembly locking mechanism 900 further comprises an elastic deformation portion 761, a projected portion 120 as a first engaging portion and the projected portion 110 as a second engaging portion. The elastic deformation portion 761 is provided with the engaging portion 760 at the leading end portion and is elastically deformable for disengagement between the engaging portion 760 and the projection 810. In this embodiment, a cut-away portion 762 is provided at each of two positions on the top surface of the engaging portion 750, and the elastic deformation portion 761 is formed so as to project from the bottom to the top of each of the cut-away portions 762. The elastic deformation portion 761 is integrally formed with the covering member 700 and is elastically deformable in the cut-away portions 762. A free end of each of the elastic deformation portions 761 is provided with an engaging portion 760 projecting toward each other. Therefore, the engaging portions 760 move towards and away from each other by the elastic deformation of the elastic deformation portion 761.

The projected portion 120 as the first engaging portion is projected upwardly at the leading end portion of the drum cartridge with respect to the inserting direction. As shown in part (a) of FIG. 28, in the state that the drum cartridge 100 is placed on the covering member 700 and the has not yet been removed in the inserting direction relative to the covering member 700, the projected portion 120 is engaged with the elastic deformation portion 761 to elastically expand the elastic deformation portion 761. A length of the projected portion 120 in the inserting direction is such that it is engaged with the elastic deformation portion 761 when drum cartridge 100 is moved relative to the covering member 700 from the insertion position by the first predetermined amount (not including the position corresponding to the end of the first predetermined amount). Therefore, in such a range, the elastic deformation portions 761 are expounded by the projected portion 120, and therefore, the engaging portion 760 and the projection 810 are not be engaged with each other as shown in part (a) of FIG. 29.

The projected portion 110 as the second engaging portion projects outwardly at the rear end of the drum cartridge 100 with respect to the inserting direction. As shown in part (c) of FIG. 28, when the drum cartridge 100 moves relative to the covering member 700 to the position corresponding to the second predetermined amount from the insertion position, the projected portion 110 is brought into engagement with the elastic deformation portion 761 to elastically deform the elastic deformation portion 761 to expand it. In this state, as shown in part (a) of FIG. 29, the engaging portion 760 and the projection 810 are not yet been engaged with each other.

Between the projected portion 110 and the projected portion 120 with respect to the inserting direction of the drum cartridge 100, no projection or the like engageable with the elastic deformation portion 761 is provided. Therefore, the elastic deformation portion 761 does not the elastically deform in the state that it is not in engagement with the projected portion 110 and the projected portion 120, and as shown in part (b) of FIG. 29, the engaging portion 760 is placed so as to be engageable with the projection 810.

In the case of the embodiment including such a main assembly locking mechanism 900, in the state that the drum cartridge 100 covered by the covering member 700 is set in the insertion position shown in FIG. 23 described hereinbefore, the covering member 700 is not locked with the main assembly 1*b*. That is, before the drum cartridge 100 is inserted, the projected portion 120 expands the elastic deformation portion 761 as shown in part (a) of FIG. 28, so that the engaging portion 760 of the covering member 700 is not engaged with the projection 810 of the main assembly 1*b*. Therefore, in this state, the covering member 700 and the drum cartridge 100 can be taken out of the main assembly 1*b*.

When the drum cartridge 100 is inserted from the insertion position by the first predetermined amount from the position of such a state, the projected portion 120 is disengaged from the elastic deformation portion 761, and the elastic deformation portion 761 elastically deforms, as shown in part (b) of FIG. 28. As a result, as shown in part (b) of FIG. 29, the engaging portion 760 and the projection 810 are engaged with each other so that the covering member 700 is locked with the main assembly 1*b* to disable the removal of the covering member 700.

In the case that the drum cartridge 100 having been inserted by more than the first predetermined amount from the insertion position is returned to the insertion position, the covering member 700 is unlocked from the main assembly 1*b*. That is, when the drum cartridge 100 is returned to the insertion position, the projected portion 120 expands the elastic deformation portion 761 to disengaging the engaging portion 760 from the projection 810 to release the locking between the covering member 700 and the main assembly 1*b*. Therefore, by returning the drum cartridge 100 to the insertion position, the covering member 700 and the drum cartridge 100 can be removed from the main assembly 1*a*.

Furthermore, when the drum cartridge 100 is inserted by the second predetermined amount from the insertion position, the projected portion 110 is engaged with the elastic deformation portion 761 to expand it, as shown in part (c) of FIG. 28. As a result, as shown in part (a) of FIG. 29, the engaging portion 760 is disengaged from the projection 810, and the locking between the covering member 700 and the main assembly 1*b* is released, so that the covering member 700 becomes capable of being pulled out.

As shown in part (a) of FIG. 30, in the state that the drum cartridge 100 is pushed to and is in the predetermined position, the covering member 700 is removed from the main assembly 1*b* (part (b) of FIG. 30), and then, the front cover 400 is closed, by which the exchanging operation of the drum cartridge 100 is completed.

Also in this embodiment, similarly to the first embodiment, the drum cartridge 100 can be removed in the state that the drum cartridge 100 is set in the insertion position main assembly 1*b*. When the drum cartridge 100 is inserted by the first predetermined amount from the social position, the covering member 700 is locked with the main assembly 1*b*. In addition, the covering member 700 is not unlocked from the main assembly 1*a* until the drum cartridge 100 is inserted by the second predetermined amount. Therefore, the covering member 700 is not unintentionally disengaged from the main assembly 1*a* during the inserting operation of the drum cartridge 100, and the drum cartridge 100 can be inserted to the predetermined mounting position while being guided by the covering member 200.

In this embodiment, not mechanism is provided for effecting the locking and unlocking between the cartridge 100 and the covering member 700, but such a mechanism may be provided similarly to the first embodiment. The other structures and functions are similar to those of the first embodiment.

Other Embodiment

In the foregoing embodiments, the unit mountable in this mountable relative to the main assembly of the apparatus has been a drum cartridge 100. However, the unit may be another type unit. For example, the unit may be a charging unit having only a charging function, a developing unit having only a developing function, a cleaner unit having only a cleaning function, an image transfer unit having only an image transfer function, an image fixing unit having only an image fixing function, or the like. In the case of the charging unit, the image formation member contributable to the image formation is a charging roller 12. Similarly, in the case of the developing unit, the image formation member is a developing sleeve 14*a* or the like. In the case of the cleaner unit, the image formation member is a cleaning blade 15 or the like. In the case of the transfer unit, the image formation member is an intermediary transfer belt 61 or the like. In the case of the image fixing unit, the image formation member is a heating roller 41 and a pressing roller 42 or the like. The unit may be a process cartridge comprising the drum cartridge 100 and the developing device 14.

When the unit of the present invention is so-called tandem type image forming apparatus, a plurality of such units are provided along a line. In such a case, all of the unit may have common structures. In this case, the structures of the developing unit or the process cartridge are common except for the colors of the toner particles, there is a possibility that the erroneous color unit may be placed. According to the present invention, the present invention permits the unit to be dismounted from the main assembly of the apparatus, when the unit is placed merely in the insertion position.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-005619 filed on Jan. 15, 2015, which is hereby incorporated by reference herein in its entirety.

What is claimed is:

1. An image forming unit detachably mountable to an image forming apparatus, the image forming unit comprising:

a main assembly that includes an image bearing member and is insertable into the image forming apparatus;

a cover portion engageable with the main assembly of the image forming unit to cover the image bearing member; and a locking portion movably provided on the cover portion and configured to lock the cover portion to the image forming apparatus, wherein, in a case that the main assembly is between (i) an initial position in which the main assembly is positioned when the setting of the cover portion to said image forming apparatus is completed and (ii) a first position in which the main assembly is inserted into the image forming apparatus from the initial position by a first amount, the locking portion is positioned in an unlocked position in which the locking portion unlocks the cover portion from the image forming apparatus, and wherein, in a case that the main assembly is between the first position and a second position in which the main assembly is inserted into the image forming apparatus from the initial position by a second amount that is larger than the first amount, the locking portion is positioned in a locked position in which the locking portion locks the cover portion to the image forming apparatus.

2. An image forming unit according to claim 1, further comprising:

a moving mechanism configured to move the locking portion between the locked position and the unlocked position when the main assembly slides relative to the cover portion, and wherein the moving mechanism moves the locking portion in the locked position to the unlocked position when the main assembly takes the initial position as a result of movement thereto from a predetermined position between the first position and the second position.

3. An image forming unit according to claim 1, wherein the locking portion includes a locking engaging portion configured to lock the cover portion by engagement with the image forming apparatus.

4. An image forming unit according to claim 1, wherein the locking portion is provided with a projection, and the image forming unit further comprises a guide portion configured to engage with the projection to guide said the projection, and wherein the locking portion is guided by the guide portion between the locked position and the unlocked position along with the inserting of the main assembly into the image forming apparatus.

5. An image forming unit according to claim 1, wherein the second amount is not less than a distance from a downstream end of the main assembly with respect to an inserting direction of the main assembly to a center of gravity of the main assembly.

6. An image forming unit according to claim 1, wherein the first amount is less than a distance from a downstream end of the main assembly with respect to an inserting direction of the main assembly to a center of gravity of the main assembly.

7. An image forming unit according to claim 1, further comprising an engaging portion engageable with the image forming apparatus to lock the main assembly with the image forming apparatus when the main assembly is mounted to the image forming apparatus, and a releasing portion for breaking engagement of the engaging portion.

8. An image forming unit according to claim 1, further comprising an inserting portion provided on the cover portion for insertion into the image forming apparatus, wherein the locking portion is provided on the inserting portion.

9. An image forming unit according to claim 1, wherein the locking portion is a first locking portion and the image forming unit further comprises a second locking portion movably provided on the cover portion and configured to lock the cover portion to the main assembly, and wherein the first locking portion and the second locking portion are integral with each other.

10. An image forming unit according to claim 9, wherein the second locking portion is movable to a position to release locking between the main assembly and the cover portion with a mounting operation of the cover portion to the image forming apparatus.

11. An image forming unit according to claim 1, wherein when the main assembly is inserted into the image forming apparatus from the initial position by the second amount, the main assembly is set in the image forming apparatus.

12. An image forming unit according to claim 1, wherein, in a case that the main assembly is the second position, the locking portion is positioned in the unlocked position.

13. An image forming unit detachably mountable to an image forming apparatus, the image forming unit comprising:

a main assembly that includes an image bearing member and is insertable into the image forming apparatus;

a cover portion engagable with the main assembly to cover the image bearing member;

a locking portion movably provided on the cover portion and configured to lock the cover portion to the image forming apparatus; and a moving mechanism configured (i) to move the locking portion between a locked position in which the locking portion locks the cover portion to the image forming apparatus and an unlocked position in which the locking portion unlocks the cover portion from the main assembly, wherein the locking portion moves from the unlocked position to the locked position when the main assembly moves to a first position in which the main assembly is inserted into the image forming apparatus by a first amount from an initial position in which the main assembly is positioned when the setting of the cover portion to the image forming apparatus is completed, and wherein the locking portion moves from the locked position to the unlocked position when the main assembly moves from the first position to a second position in which the main assembly is inserted into the image forming apparatus from the initial position by a second amount that is larger than the first amount.

14. An image forming unit according to claim 13, wherein, when the main assembly is inserted into the image forming apparatus from the initial position by the second amount, the main assembly is set in the image forming apparatus.

15. An image forming unit detachably mountable to an image forming apparatus, the image forming unit comprising:

a main assembly that includes an image bearing member and is insertable into the image forming apparatus;

a cover portion engaging with the main assembly to cover the image bearing member;

a first locking portion movably provided on the cover portion and configured to lock the cover portion to the image forming apparatus;

a second locking portion movably provided on the cover portion and configured to lock the cover portion to the main assembly, wherein the second locking portion is movable to a position to release locking between the main assembly and the cover portion with a mounting operation of the cover portion to the image forming apparatus; and a moving mechanism configured to move the first locking portion between a locked position in which the first locking portion locks the cover portion to the image forming apparatus and an unlocked position in which the first locking portion unlocks the cover portion from the image forming apparatus when the main assembly slides relative to the cover portion, wherein the first locking portion and the second locking portion are integral with each other.

16. An image forming unit detachably mountable to an image forming apparatus, the image forming unit comprising:

a main assembly that includes an image bearing member and is insertable into the image forming apparatus;

a cover portion engaging with the main assembly to cover the image bearing member;

a first locking portion movably provided on the cover portion and configured to lock the cover portion to the image forming apparatus;

a second locking portion movably provided on the cover portion and configured to lock the cover portion to the main assembly, wherein the second locking portion is movable to a position to release locking between the main assembly and the cover portion with a mounting operation of the cover portion to the image forming apparatus; and a moving mechanism configured to move the first locking portion between a locked position in which the first locking portion locks the cover portion to the image forming apparatus and an unlocked position in which the first locking portion unlocks the cover portion from the image forming apparatus when the main assembly slides relative to the cover portion, wherein, when the second locking portion moves to the position to release locking between the main assembly and the cover portion with the mounting operation of the cover portion to the image forming apparatus, the first locking portion is the unlocked position, wherein, when the main assembly moves relative to the cover portion by a first amount as the main assembly is inserted into the image forming apparatus, the first locking portion in the unlocked position moves to the locked position, and wherein, when the main assembly moves relative to the cover portion by a second amount that is larger than first amount as the main assembly is inserted into the image forming apparatus, the first locking portion in the locked position moves to the unlocked position.

17. A drum unit detachably mountable to an image forming apparatus, the drum unit comprising:

a drum cartridge that includes a photosensitive drum and is insertable into the image forming apparatus;

a cover member engageable with the drum cartridge to cover the photosensitive drum; and an engaging portion provided on the covering member and engageable with the image forming apparatus so as to prevent the cover member from disengaging from the image forming apparatus when the cover member is set at a predetermined position in the image forming apparatus and then the drum cartridge moves toward a set position in the image forming apparatus by a predetermined distance.

18. A drum unit according to claim 17, wherein the engaging portion is released from the image forming apparatus when the drum cartridge is returned to the cover member after the engaging portion is engaged with the image forming apparatus.

19. A drum unit according to claim 17, wherein the engaging portion is released from the image forming apparatus when the drum cartridge is moved toward the set position by a second predetermined distance after the engaging portion is engaged with the image forming apparatus.

20. A drum unit according to claim 17, further comprising a second engaging portion provided on the cover member and engageable with the drum cartridge so as to prevent the cover member from disengaging from the drum cartridge before the cover member is set in the image forming apparatus, wherein the second engaging portion is released from the drum cartridge when the cover member is set in the image forming apparatus.

21. A drum unit according to claim 20, wherein the first and second engaging portion are integral with each other.

* * * * *